US008038285B2

(12) United States Patent
Uemura et al.

(10) Patent No.: US 8,038,285 B2
(45) Date of Patent: Oct. 18, 2011

(54) INTERMITTENT APPLICATION METHOD AND APPARATUS, AND INKJET RECORDING METHOD AND APPARATUS

(75) Inventors: Hiroshi Uemura, Kanagawa-ken (JP); Tamito Kagami, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 625 days.

(21) Appl. No.: 12/233,108

(22) Filed: Sep. 18, 2008

(65) Prior Publication Data

US 2009/0079808 A1 Mar. 26, 2009

(30) Foreign Application Priority Data

Sep. 20, 2007 (JP) ..... 2007-244071

(51) Int. Cl.
*B41J 2/175* (2006.01)
*B41J 2/01* (2006.01)
*B05D 1/26* (2006.01)

(52) U.S. Cl. ..... 347/103

(58) Field of Classification Search ..... 347/103, 347/84, 85

See application file for complete search history.

(56) References Cited

U.S. PATENT DOCUMENTS

| | | | | |
|---|---|---|---|---|
| 4,129,077 | A * | 12/1978 | Fischer | 101/350.2 |
| 4,361,090 | A * | 11/1982 | Klingler et al. | 101/350.2 |
| 5,989,622 | A * | 11/1999 | Iwashita et al. | 427/58 |
| 6,284,405 | B2 * | 9/2001 | Kaido et al. | 429/94 |
| 2005/0110856 | A1 | 5/2005 | Mouri et al. | |

FOREIGN PATENT DOCUMENTS

| | | | |
|---|---|---|---|
| JP | 2002-321350 | A | 11/2002 |
| JP | 2005-170036 | A | 6/2005 |

* cited by examiner

*Primary Examiner* — Huan Tran

(74) *Attorney, Agent, or Firm* — Birch, Stewart, Kolasch & Birch, LLP

(57) ABSTRACT

The intermittent application method of intermittently applying an application liquid to a continuously conveyed band-shaped or cut-sheet-shaped supporting body, includes the step of causing a lower surface of the supporting body, and a circumferential surface of an application cylinder which takes up the application liquid from an application liquid reservoir by rotation, to make contact with each other and separate from each other in a relative manner by means of a cam mechanism in such a manner that an application section where the application liquid is applied, and a non-application section where the application liquid is not applied, are formed on the lower surface of the supporting body.

13 Claims, 14 Drawing Sheets

APPLICATION IN PROGRESS (AT CAM ORIGIN POSITION) START ACTIVATION

COMPLETE ACTIVATION START LOWERING

COMPLETE LOWERING START SEPARATION

COMPLETE SEPARATION START RAISING

INTERMITTENT APPLICATION METHOD AND APPARATUS, AND INKJET RECORDING METHOD AND APPARATUS

BACKGROUND OF THE INVENTION

1. Field of the Invention

The present invention relates to an intermittent application method and apparatus, and an inkjet recording method and apparatus, and to technology for intermittently applying an application liquid with high accuracy onto a supporting body by means of an application cylinder, and more particularly, to technology for intermittently applying a treatment liquid with high accuracy onto a supporting body (for example, an intermediate transfer body) in a two-liquid transfer type of inkjet recording method and apparatus wherein an ink image formed by causing two liquids, such as ink and treatment liquid, to react together on an intermediate transfer body is transferred onto a recording medium.

2. Description of the Related Art

An inkjet recording method performs recording by ejecting droplets of ink respectively from a plurality of ejection nozzles which are formed in an inkjet head, and this type of method is used widely since it enables images of high quality to be recorded onto recording media of a wide variety of types, while incurring low running costs and producing little noise during the recording operation.

There are known inkjet recording methods in which an ink image is formed temporarily on an intermediate transfer body by ejecting droplets of ink onto the intermediate transfer body from an inkjet head, and the ink image is then transferred onto a recording medium (for example, paper) by a roller, in a transfer part. According to a transfer type of inkjet recording method of this kind, it is possible to remove ink solvent (for example, water, or the like) on the intermediate transfer body by means of a solvent removal roller or the like, and then transfer the image onto the recording medium. Therefore, problems such as bleeding of the image, printing through to the rear surface, deformation of the recording medium (so-called cockling), and the like, which are caused by the presence of ink solvent, are avoided, and therefore an image of high quality can be obtained.

The intermediate transfer body may be an endless belt formed in the shape of a band, which is conveyed by being wrapped about a plurality of rollers, or it may be a sheet-fed intermediate transfer body which is conveyed on a conveyor belt, or the intermediate transfer body may be a drum-shaped member.

Furthermore, an inkjet recording method is also known which is a two-liquid method of promoting fixing of ink by forming an ink image by causing reaction of two liquids, namely, an ink and a treatment liquid which aggregates the ink. A two-liquid method of this kind is used also in a system which forms an image directly on a recording medium, in addition to a transfer system such as that described above.

Japanese Patent Application Publication No. 2002-321350 and Japanese Patent Application Publication No. 2005-170036 disclose related art technology which applies a two-liquid method to a transfer type of inkjet recording method. These publications state that it is possible to use, as a device which applies treatment liquid to an intermediate transfer body, an application roller system or spray nozzle system which is able to apply treatment liquid to the whole surface of the intermediate transfer body, as well as ejection nozzles which eject treatment liquid as liquid droplets.

However, the full surface of the intermediate transfer body does not necessarily form an image region for forming an ink image, and there may be an image region where an ink image is formed and a non-image region where an ink image is not formed. For example, sheets of a recording medium, such as cut paper, are supplied at a uniform spacing to the transfer roller, and the portion of the intermediate transfer body corresponding to the uniform spacing forms a non-image region.

Consequently, as shown in FIG. 13A, intermittent application is required in which a treatment liquid is applied only to the image regions 12A (black diagonally hatched regions) of the intermediate transfer body 12 which correspond to the recording media, and treatment liquid is not applied to the non-image regions 12B (white regions) of the intermediate transfer body which correspond to the uniform spacing. Furthermore, even if band-shaped recording media are supplied continuously to the transfer unit, then since an image region 12A and a non-image region 12B are formed on the intermediate transfer body 12 as shown in FIG. 13B, intermittent application for applying treatment liquid only onto the image regions 12A (black diagonally hatched regions) is required. In other words, on-demand application is required for applying treatment liquid in an intermittent fashion, only to the required regions of the intermediate transfer body 12.

If treatment liquid is applied to the whole surface of the intermediate transfer body 12 as in the related art, then not only is the treatment liquid used wastefully, but this can also lead to problems such as the occurrence of foreign material and increase in the cleaning load, as described below.

In other words, since the treatment liquid which has been applied to the non-image regions 12B of the intermediate transfer body 12 may adhere to the roller of the transfer unit, and the like, during transfer, then if the treatment liquid adheres to the roller in this way a large number of times, the treatment liquid forms foreign matter, which is then transferred to the recording medium.

As a countermeasure against foreign material, a composition is possible in which a cleaning apparatus for the intermediate transfer body 12 is provided on the downstream side of the transfer unit, but if there is a large amount of treatment liquid remaining on the intermediate transfer body 12, then the cleaning load will be very great. In particular, if the treatment liquid includes components such as a strong acidic material or alkali material, then these can be causes of degradation of the intermediate transfer body 12 itself, or of corrosion of the roller of the transfer unit.

Furthermore, the length of the non-image region 122B where treatment liquid is not applied to the intermediate transfer body 12 is generally an extremely short length of the order of a millisecond (msec) when converted to time. Consequently, highly accurate application technology is required in order to halt the application instantaneously for the non-image region 12B of the intermediate transfer body 12. Moreover, due to demands for image quality of high resolution and reduced drying time for transfer, technology is also required which is able to apply the treatment liquid in an extremely thin film of several microns, at a uniform thickness, on the intermediate transfer body 12.

If the application roller system and the spray nozzle system described in Japanese Patent Application Publication No. 2002-321350 and Japanese Patent Application Publication No. 2005-170036 are considered in view of these requirements relating to the application of treatment liquid, then although a spray nozzle can turn the spray of treatment liquid on and off with relatively good accuracy, by controlling the opening and closing of a valve, for example, it is difficult to apply an extremely thin film uniformly.

On the other hand, an application apparatus which comprises an application cylinder, such as an application roller apparatus, is excellent for applying a uniform thin film, but this structure is not beneficial for switching the supply of treatment liquid on and off. Therefore, such an apparatus is not suitable for highly accurate intermittent application in which the application of liquid is halted instantaneously when changing from the image region 12A to the non-image region 12B on the intermediate transfer body 12.

In view of these circumstances, an apparatus which is capable of highly accurate intermittent coating by comprising a function for instantaneously halting application and restarting application is required as an application apparatus comprising an application cylinder, and an intermittent application apparatus of this kind would be highly valuable not only in the field of applying treatment liquid in an inkjet recording apparatus, but also in various other technical fields.

SUMMARY OF THE INVENTION

The present invention has been contrived in view of these circumstances, an object thereof being to provide an intermittent application method and an intermittent application apparatus whereby, even with an application apparatus based on an application cylinder system, which is excellent for applying a uniform thin film but which is structurally inappropriate for achieving intermittent application, the application of liquid can be interrupted only in a required region of the supporting body.

Furthermore, it is another object of the present invention to provide an inkjet recording method and an inkjet recording apparatus in which liquid can be applied with good accuracy, to the image region of a supporting body (for example, an intermediate transfer body) only, by applying the technology of the aforementioned intermittent application method and intermittent application apparatus to the technical field of inkjet recording, and therefore requirements in terms of achieving high resolution and high image quality and reducing the drying time for transfer, can be satisfied, while also avoiding wasteful consumption of treatment liquid, preventing the occurrence of foreign material, and reducing the cleaning load.

In order to attain at least one of the aforementioned objects, the present invention is directed to an intermittent application method of intermittently applying an application liquid to a continuously conveyed band-shaped or cut-sheet-shaped supporting body, the intermittent application method comprising the step of causing a lower surface of the supporting body, and a circumferential surface of an application cylinder which takes up the application liquid from an application liquid reservoir by rotation, to make contact with each other and separate from each other in a relative manner by means of a cam mechanism in such a manner that an application section where the application liquid is applied, and a non-application section where the application liquid is not applied, are formed on the lower surface of the supporting body.

In this aspect of the invention, since a cam mechanism is used as a mechanism for causing the lower surface of the supporting body and the circumferential surface of the rotating application cylinder to come into contact with each other and separate from each other in a relative manner, in order to apply the application liquid intermittently, only to the region of the supporting body where it is required, then it is possible to carry out the contacting and separating operations instantaneously.

Consequently, even if using an application apparatus based on an application cylinder which is not structurally appropriate for intermittent application, it is still possible to apply the application liquid with good accuracy, to a required region of the supporting body only.

Desirably, the application cylinder is rotated at same speed of rotation during separation of the supporting body and the application cylinder as speed of rotation of the application cylinder during contact between the supporting body and the application cylinder.

In this aspect of the invention, since the application cylinder is rotated at the same speed of rotation during separation of the supporting body and the application cylinder as the speed of rotation during contact between the supporting body and the application cylinder, then it is possible to form the same film thickness of the application liquid on the circumferential surface of the application cylinder as that formed during application of the liquid, at all times. By this means, it is possible to start application again with good accuracy, when the application liquid is applied again by making the supporting body and the application cylinder which are in a separated state, come into contact with each other instantaneously.

Desirably, the cam mechanism causes the application cylinder to make contact with and separate from the supporting body.

This aspect shows a mode where the supporting body and the application cylinder are caused to make contact with each other and to separate from each other in a relative manner by means of a cam mechanism, and it relates to a case where the contact and separation are achieved by moving the application cylinder with respect to the supporting body.

Desirably, the cam mechanism causes the supporting body to make contact with and separate from the application cylinder.

This aspect shows a further mode where the supporting body and the application cylinder are caused to make contact with each other and to separate from each other in a relative manner by means of a cam mechanism, and it relates to a case where contact and separation are achieved by moving the supporting body with respect to the application cylinder.

In order to attain at least one of the aforementioned objects, the present invention is also directed to an inkjet recording method comprising a treatment liquid application step of previously applying a treatment liquid to aggregate an ink to a continuously conveyed band-shaped or cut-sheet-shaped supporting body, before ejecting the ink onto the supporting body, wherein, in the treatment liquid application step, a lower surface of the supporting body, and a circumferential surface of an application cylinder which takes up the treatment liquid from a treatment liquid reservoir by rotation are caused to come into contact with each other and separate from each other in a relative manner by means of a cam mechanism, in such a manner that the treatment liquid is applied intermittently only onto an image region on a lower surface of the supporting body where an ink image is to be formed and is not applied onto a non-image region on the lower surface of the supporting body where an ink image is not to be formed.

In this aspect of the invention, since a cam mechanism is used as a mechanism for causing the lower surface of the supporting body and the circumferential surface of the rotating application cylinder to come into contact with each other and separate from each other in a relative manner, in order to apply the treatment liquid intermittently, only to the image region of the supporting body, then it is possible to carry out the contacting and separating operations instantaneously. Consequently, even if using an application apparatus based on an application cylinder which is not highly suitable for intermittent application in structural terms, it is still possible to apply the treatment liquid with good accuracy, only to the image region of the supporting body (for example, an intermediate transfer body). As a result, it is possible to satisfy the demands of achieving high resolution and high image quality, as well as shortening the drying time for transfer, and it is also possible to avoid wasteful consumption of the treatment liquid, prevent the occurrence of foreign matter, and reduce the cleaning load.

In the case of an inkjet recording method such as this, it is desirable that the application cylinder should be rotated at the same speed of rotation during separation between the supporting body and the application cylinder, as the speed of rotation during contact between the supporting body and the application cylinder. Furthermore, the mode of causing the lower surface of the supporting body and the circumferential surface of the rotating application cylinder to make contact with each other and to separate from each other in a relative manner by means of a cam mechanism, may be based on causing the application cylinder to make contact with and separate from the supporting body, or it may be based on causing the supporting body to make contact with and separate from the application cylinder.

Desirably, the supporting body is an intermediate transfer body on which the ink reacts with the treatment liquid to form the ink image and which transfers the image onto a recording medium.

An aspect of the present invention can be applied to an inkjet recording method based on a two-liquid transfer method, and this aspect may relate to a case where treatment liquid is applied intermittently to the intermediate transfer body.

Desirably, the supporting body is a recording medium on which the ink reacts with the treatment liquid to form the ink image.

This aspect of the invention relates to a case where an embodiment of the present invention is applied to a general mode where an ink image is formed directly on a recording medium according to an inkjet recording method, and the treatment liquid is applied intermittently to the recording medium.

In order to attain at least one of the aforementioned objects, the present invention is also directed to an intermittent application apparatus which intermittently applies an application liquid to a continuously conveyed band-shaped or cut-sheet-shaped supporting body, the intermittent application apparatus comprising: an application head having an application cylinder which takes up the application liquid from an application liquid reservoir and applies the application liquid to the supporting body while rotating; and an elevator movement apparatus having a cam mechanism which raises and lowers the application head or the supporting body to cause the supporting body and a circumferential surface of the application cylinder to make contact with each other and separate from each other in a relative manner in such a manner that the application liquid is intermittently applied to the supporting body.

This aspect can be realized by applying an embodiment of the present invention to an apparatus, and can obtain some of the beneficial effects similar to those described above.

Desirably, the application cylinder is rotated at same speed of rotation during separation of the supporting body and the application cylinder as speed of rotation of the application cylinder during contact between the supporting body and the application cylinder.

In this aspect of the invention, it is possible to obtain some of the beneficial effects similar to those described above.

Desirably, the cam mechanism includes: a circular disk-shaped cam member which is driven to rotate and has at least one cam groove formed in a circumferential surface of the circular disk-shaped cam member; and a cam follower which is disposed in contact with the circular disk-shaped cam member so that the cam follower can be driven and rotated by the circular disk-shaped cam member, and which is raised and lowered instantaneously by dropping into the at least one cam groove and exiting from the at least one cam groove while the circular disk-shaped cam member is driven to rotate, wherein the application head is raised and lowered in conjunction with raising and lowering movement of the cam follower; and a contact position of the cam follower with respect to the circular disk-shaped cam member when the circular disk-shaped cam member starts rotation is a position on the circumferential surface of the circular disk-shaped cam member which is furthest from the at least one cam groove.

This aspect of the invention comprises a cam mechanism which raises and lowers the application head with respect to the supporting body so as to apply liquid intermittently. In particular, the contact position of the cam follower with respect to the cam member when the rotation of the cam member is started is set to a position on the circumferential surface of the cam member which is furthest from the cam groove. Consequently, since it is possible to ensure a sufficient distance for the cam follower to fall into the cam groove due to the rotation of the cam member, then it is possible to accelerate the rotation of the cam member until the cam follower drops into the groove. Consequently, it is possible to halt application of liquid by instantaneously separating the application cylinder of the application head with respect to the supporting body, as well as being able to restart the application instantaneously from the halted state.

Desirably, the cam mechanism includes: a circular disk-shaped cam member which is driven to rotate and has at least one cam projection formed in a circumferential surface of the circular disk-shaped cam member; and a cam follower which is disposed in contact with the circular disk-shaped cam member so that the cam follower can be driven and rotated by the circular disk-shaped cam member, and which is raised and lowered instantaneously by being caused to project out by the at least one cam projection and exiting from the at least one cam projection while the circular disk-shaped cam member is driven to rotate, wherein the supporting body is raised or lowered in conjunction with raising and lowering movement of the cam follower; and a contact position of the cam follower with respect to the circular disk-shaped cam member when the circular disk-shaped cam member starts rotation is a position on the circumferential surface of the circular disk-shaped cam member which is furthest from the at least one cam projection.

This aspect of the invention comprises a cam mechanism which raises and lowers the supporting body with respect to the application head so as to apply liquid intermittently. In particular, the contact position of the cam follower with respect to the cam member when the rotation of the cam member is started is set to a position on the circumferential surface of the cam member which is furthest from the cam projection. Consequently, since it is possible to ensure a sufficient distance for the cam follower to be caused to project out by the cam projection due to the rotation of the cam member, then it is possible to accelerate the rotation of the cam member until it projects out. Consequently it is possible to halt application of liquid by instantaneously separating the supporting body with respect to the application cylinder of the application head, as well as being able to restart the application instantaneously from the halted state.

Desirably, the elevator movement apparatus includes a guide mechanism which guides an operation of causing the supporting body and the circumferential surface of the application cylinder to come into contact with each other and to separate from each other in a relative manner.

In this aspect of the invention, since the elevator movement apparatus comprises a guide mechanism, then it is possible to stabilize the operation of causing the supporting body and the circumferential surface of the application cylinder to come into contact with each other and separate from each other in a relative manner, by means of a cam mechanism.

In order to attain at least one of the aforementioned objects, the present invention is also directed to an inkjet recording apparatus comprising a treatment liquid application unit which previously applies a treatment liquid to aggregate an ink to a continuously conveyed band-shaped or cut-sheet-shaped supporting body, before ejecting the ink onto the supporting body, wherein the treatment liquid application unit includes, an application apparatus having an application cylinder which takes up the treatment liquid from a treatment liquid reservoir and applies the treatment liquid to the supporting body while rotating; and an elevator movement apparatus having a cam mechanism which raises and lowers the application apparatus or the supporting body to cause the supporting body and a circumferential surface of the application cylinder to make contact with each other and separate from each other in a relative manner in such a manner that the treatment liquid is intermittently applied to the supporting body.

In this aspect of the invention, technology of the intermittent application apparatus according to an embodiment of the present invention is applied to a treatment liquid application unit of an inkjet recording apparatus, and the treatment liquid can be applied with good accuracy, only to the image region of the supporting body (for example, an intermediate transfer body). Therefore, it is possible to satisfy demands for high resolution and high image quality, and reduced drying time for transfer, as well as being able to avoid wasteful consumption of treatment liquid, prevent the occurrence of foreign matter, and reduce the is cleaning load.

In the case of an inkjet recording apparatus such as this, it is desirable that the application cylinder should be rotated at the same speed of rotation during separation between the supporting body and the application cylinder, as the speed of rotation during contact. Furthermore, desirably, the cam mechanism is able to desirably adopt some of the compositions described above.

As described above, according to an intermittent application method and an intermittent application apparatus based on the present invention, even if using an application apparatus based on an application cylinder which is excellent for applying a uniform ultra-thin film, but which is not highly suitable for intermittent application in structural terms, it is still possible to apply the application liquid with good accuracy, to the required region of the supporting body only.

Furthermore, according to an inkjet recording method and an inkjet recording apparatus based on the present invention, the treatment liquid can be applied with good accuracy, only to the image region of the supporting body (for example, an intermediate transfer body). Therefore, it is possible to satisfy demands for high resolution and high image quality, and reduced drying time for transfer, as well as being able to avoid wasteful consumption of treatment liquid, prevent the occurrence of foreign matter, and reduce the cleaning load.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

In modes of an inkjet recording apparatus according to embodiments of the present invention described below, an intermittent application apparatus according to an embodiment of the present invention is applied to a treatment liquid application unit, which is one component of the apparatus. The application liquid of an intermittent application apparatus according to embodiments of the present invention corresponds to the treatment liquid used in an inkjet recording apparatus.

General Composition of Inkjet Recording Apparatus

Figure 1:
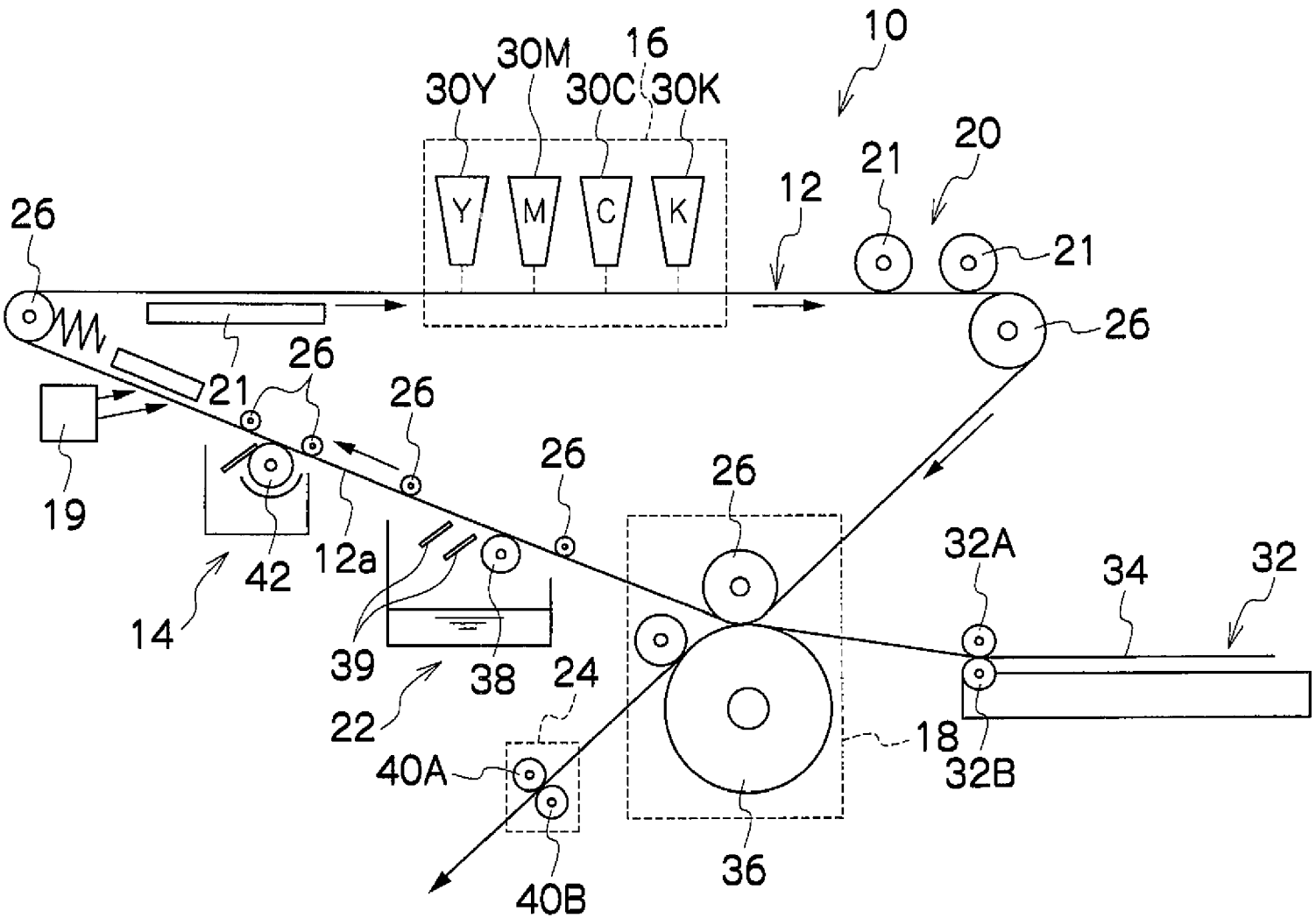
FIG. 1 is a general schematic drawing of an inkjet recording apparatus according to an embodiment of the present invention.

FIG. 1 is one example showing the overall composition of a two-liquid type of inkjet recording apparatus relating to an embodiment of the present invention.

As shown in FIG. 1, the inkjet recording apparatus 10 principally comprises: an intermediate transfer body 12 (supporting body), a treatment liquid application unit 14, an ink ejection unit 16, and a transfer unit 18, and it also comprises a solvent removal unit 20, a cleaning unit 22, an image fixing unit 24 and a paper supply unit 32.

The intermediate transfer body 12 is composed by an endless belt having a prescribed width, and is composed by being wound about a plurality of rollers 26. The intermediate transfer body 12 is not limited to being an endless belt, and it may also employ a method where a cut-sheet intermediate transfer body is conveyed by a conveyor belt, or it may use a drum-shaped member. The motive force of a motor (not shown) is transmitted via a gear reducing device to at least one main roller of the plurality of rollers 26, and the intermediate transfer body 12 is conveyed continuously by the driving of this motor in such a manner that the intermediate transfer body 12 rotates about the outer side of the rollers 26 in the clockwise direction indicated by arrows in FIG. 1 (hereinafter, called the "transfer body rotation direction").

The treatment liquid application unit 14 is composed as an apparatus for performing intermittent application, in which the treatment liquid L which moves with the rotation of the application cylinder is applied only onto the image regions 12A (see FIGS. 13A and 13B) where the ink image is to be formed, of the lower surface (recording surface 12*a*) of the intermediate transfer body 12 which is conveyed in a continuous fashion, and the treatment liquid L is not applied to the non-image regions 12B. Desirably, the thickness of the treatment liquid L applied onto the intermediate transfer body 12 is an extremely thin film of 1 to 5 μm in a wet state, and is applied in a uniform fashion. The elevator movement apparatus for performing intermittent application is described in detail in the section on "Structure of treatment liquid application unit" given below. Here, the non-image regions 12B of the intermediate transfer body 12 include an intermediate transfer section which corresponds to the interval between sheets of the recording medium where the recording medium is not present, when recording media, such as cut-sheet paper, are supplied to the transfer unit 18 at a uniform spacing.

Furthermore, depending on the type of treatment liquid L applied by the treatment liquid application unit 14, as shown in FIG. 1, it is also possible to provide a drying apparatus 19 for drying the applied thin film of treatment liquid L, to the downstream side of the treatment liquid application unit 14 in terms of the transfer body rotation direction, and a cooling apparatus 21 which cools the intermediate transfer body 12 that has been warmed by the drying apparatus 19, to the downstream side of the drying apparatus 19 in terms of the transfer body rotation direction.

The ink ejection unit 16 is disposed to the downstream side of the treatment liquid application unit 14 in terms of the transfer body rotation direction. The ink ejection unit 16 comprises recording heads (ink heads) 30K, 30C, 30M and 30Y which correspond to the respective colors of ink of black (K), cyan (C), magenta (M) and yellow (Y). Respective inks which satisfy the ink composition conditions of embodiments of the present invention are stored in respective ink storage units (not shown) which correspond to the inks of respective colors, and these inks are supplied to the respective recording heads 30K, 30C, 30M and 30Y.

Each of the ink heads 30K, 30C, 30M and 30Y ejects the ink of the corresponding color, from an ejection surface which opposes the intermediate transfer body 12. Accordingly, the inks of the respective colors are deposited onto the recording surface 12*a* of the intermediate transfer body 12.

Each of the ink heads 30K, 30C, 30M and 30Y is a full line head in which a plurality of ejection ports (nozzles) are formed through the maximum recording width of the image formed on the intermediate transfer body 12. Therefore, it is possible to record images at high speed on the intermediate transfer body 12, in comparison with a serial type of head which performs recording while scanning (moving) a short shuttle head back and forth in the breadthways direction of the intermediate transfer body 12 (the front to back direction with respect to the plane of the drawing in FIG. 1). Of course, embodiments of the present invention are also suitable for a serial system which has a relatively high recording speed, for example, a one-pass recording system which forms one line in one scanning action.

In the present embodiment, all of the ink heads 30K, 30C, 30M and 30Y have the same structure, and hereinafter, the reference numeral 30 is used to indicate a representative example of these ink heads.

If the treatment liquid L is applied intermittently onto the image regions of the intermediate transfer body 12 from the treatment liquid application unit 14, the image regions of the intermediate transfer body 12 on which the treatment liquid L has been deposited is moved sequentially to directly below the ink heads 30K, 30C, 30M and 30Y, due to the rotation of the intermediate transfer body 12, and the inks of the corresponding colors are ejected respectively from the ink heads 30K, 30C, 30M and 30Y.

Desirably, the treatment liquid application volume and the ink deposition volume are adjusted in accordance with requirements. For example, it is possible to change the amount of treatment liquid applied in accordance with the recording medium 34 to which the image is transferred, in order to adjust the viscosity and other properties of the ink image which is created by the mixing of the treatment liquid L and the ink. Moreover, it is also possible to include wax in the treatment liquid, from the viewpoint of improving transfer properties by imparting separating characteristics or by imparting internal adhesive force to the ink film. More desirably, the wax is added in the form of an emulsion. Desirably, the added amount of the solid component in the emulsion is equal to or greater than 0.05 wt %, by weight ratio, with respect to the total solid component in the ink, in order to obtain good separation performance and good adhesive strength inside the ink film. If the added amount is less than 0.05 wt %, then a sufficient separating effect is not obtained. As the added amount of the emulsion gradually increases, the reliability of the ink gradually declines, and therefore it is desirable that the solid component should be restricted to approximately 30 wt % with respect to the total amount of ink. The wax used may be carnuba wax, paraffin wax, microcrystalline wax, montan wax, alcohol wax, polyethylene wax, PTFE wax, synthetic acid wax, α olefine—anhydrous maleic acid copolymer, or the like. Furthermore, it is also possible to form a separating layer by depositing a separating component only, in a separate fashion, before depositing treatment liquid.

The solvent removal unit 20 is disposed to the downstream side of the ink ejection unit 16 in terms of the transfer body rotation direction. A plurality of solvent removal rollers 21 (in FIG. 1, two rollers) are provided in the solvent removal unit 20, on the recording surface 12*a* side of the intermediate transfer body 12. The solvent removal rollers 21 are made of a roller-shaped porous material, and are disposed so as to abut against the recording surface 12*a* of the intermediate transfer body 12. Other possible modes are, for example, a system which removes excess solvent from the intermediate transfer body 12 by means of an air knife, and a system which evaporates the solvent by heating. Any solvent removal system may be adopted, but desirably, a system which does not employ heat is used. In the case of a device which evaporates solvent by heating the surface of the transfer body or by applying heat to the aggregate on the transfer body, there may be cases where an excessive amount of solvent is removed by excessive heating of the aggregate, and therefore desirable viscosity cannot be maintained in the aggregate during transfer, thereby degrading the transfer characteristics. A further concern is the effect of the heat of the intermediate transfer body on the ink ejection characteristics from the inkjet head.

In the solvent removal unit 20, the solvent on the recording surface 12*a* of the intermediate transfer body 12 is removed by the solvent removal rollers 21. Therefore, even in cases where a large amount of treatment liquid is deposited on the recording surface 12*a* of the intermediate transfer body 12, since the solvent is removed by the solvent removal unit 20, then a large amount of solvent (dispersion medium) is not transferred to the recording medium 34 in the transfer unit 18. Consequently, even in a case where paper, or the like, is used as the recording medium 34, there is no occurrence of problems based on characteristic of water-based solvents, such as curling, cockling, or the like.

By removing excess solvent from the ink image by means of the solvent removal unit 20, the ink image is condensed and the internal aggregating force is enhanced yet further. Consequently, fusion of the resin particles contained in the ink image is promoted effectively, and a stronger internal aggregating force can be applied to the aggregate material, up until the transfer step. Moreover, it is also possible to impart good fixing characteristics and luster to the image, after transfer to the recording medium, due to the effective condensation of the ink image by removal of the solvent.

There is no particular need to remove all of the solvent by the solvent removal unit 20. If the ink image is condensed excessively by removing an excessive amount of solvent, then the adhesive force between the ink image and the transfer body becomes too strong, and therefore a very large pressure is needed for transfer, which is not desirable. Rather, in order to maintain the viscoelasticity which is suitable for transfer, it is desirable to leave a small amount of solvent. One of the beneficial effects obtained by leaving a small amount of residual solvent is that since the ink image is hydrophobic, and the non-volatile solvent component principally, the organic solvent, such as glycerine) is hydrophilic, then the ink image and the residual solvent component separate after carrying out solvent removal, and a thin layer of liquid comprising the residual solvent component is formed between the ink image and the intermediate transfer body. Consequently, the adhesive force of the ink image to the transfer body becomes weak, which is beneficial for improving transfer characteristics.

The transfer unit 18 is disposed to the downstream side of the solvent removal roller 20 in terms of the transfer body rotation direction. A pressurization and heating roller 36 is provided in the transfer unit 18 at a position which opposes the transfer unit roller 26, via the intermediate transfer body 12. A heater (not shown) is provided inside the pressurization and heating roller 36, in such a manner that the temperature of the outer circumferential surface of the pressurization and heating roller 36 is raised by this heater. The recording medium 34 (for example, cut-sheet paper) is conveyed from right to left in FIG. 1, so as to pass from the paper supply unit 32 and between the intermediate transfer body 12 and the pressurization and heating roller 36. When the recording medium 34 passes between the intermediate transfer body 12 and the pressurization and heating roller 36, then the front surface of the recording medium 34 makes contact with the recording surface 12*a* of the intermediate transfer body 12, and pressurization and heating is carried out by the pressurization and heating roller 36, from the rear surface of the recording medium 34. The surface temperature in the transfer section of the intermediate transfer body 12 is raised to the transfer temperature and the ink image formed on the intermediate transfer body 12 is thereby softened to an appropriate softened state. The ink image formed on the recording surface 12*a* of the intermediate transfer body 12 is transferred to the recording medium 34, in this state. In the present embodiment, a desirable structure is one where the heating section is limited only to the transfer section of the intermediate transfer body 12. If this structure is adopted, it is possible to prevent excessive thermal load caused by heating the whole surface of the transfer body, and to prevent excessive removal of the solvent component included in the ink image. Moreover, by heating the ink image in the transfer unit 18, almost all of the solvent contained in the ink image is removed, and due to fusion of the resin which is promoted by the combined effect of the physical condensation of the ink image caused by pressurization, it is possible to impart an even stronger internal aggregating force to the ink image, in the short period of time from immediately before the transfer step until the execution of transfer, in the region where the intermediate transfer body 12 makes contact with the pressurization and heating roller 36.

As described above, the transfer temperature is the surface temperature of the transfer section of the intermediate transfer body 12, and the surface temperature of the pressurization and heating roller 36 is set to a higher temperature than this transfer temperature, in order to take account of the fact that the intermediate transfer body 12 is heated via the recording medium. In this case, before the recording medium 34 is conveyed to the transfer unit 18, it is also possible to provide a recording medium heating device which applies a heating process to the recording medium 34. For example, a heating device is applied to a pair of paper supply rollers 32A and 32B which are provided in the paper supply unit 32, and the recording medium 34 is heated prior to being supplied.

When the recording medium 34 which makes direct contact with the ink image reaches a desired transfer temperature, it is possible to transfer the heat effectively during transfer. Furthermore, by previously heating the recording medium 34, the ink image is melted immediately upon transfer and enters into the indentations and capillaries of the surface of the recording medium, thereby producing an anchoring effect due to the increased contact surface area. As a result of this anchoring effect, the adhesive force between the recording medium 34 and the ink image is enhanced and transfer is carried out in a satisfactory fashion. Furthermore, it is possible to improve the fixing characteristics of the image after transfer to the recording medium 34. Moreover, it is possible to improve the smoothness of the image, and this has a beneficial effect in imparting granularity and luster to the image. Desirably, the heating temperature of the recording medium 34 can be adjusted freely in accordance with the type of recording medium 34.

If there are a large number of indentations in the surface of the paper caused by pulp fibers, as in the case of normal paper, high-grade paper, or the like, then a strong anchoring effect can be expected between the ink image and the surface of the recording medium, and in this case, by adjusting the viscosity of the ink image through adjusting the temperature of the surface portion of the recording medium 34 by means of the paper supply rollers 32A and 32B, in addition to the heating temperature in the heating unit 18, it is possible to achieve an optimal adhesive force in the ink image, and hence to impart good fixing properties of the image to normal paper, high-grade paper, or the like. For example, a recording medium 34 having a smooth surface, such as coated paper, has a high thermal conduction efficiency in the surface portion, and therefore the heating temperature may be set to a relatively low temperature. On the other hand, in the case of a recording medium having surface indentations, such as high-grade paper, an air layer is liable to be interposed between the paper and the ink image, and therefore it is desirable to set the heating temperature to a relatively higher temperature, since this can be expected to produce a good anchoring effect due to the increase in the adhesive force of the polymer component.

Furthermore, even if a solvent removal process is not carried out before transfer, since the solvent can be removed by heating in a short period of time, then there is not much of a problem with the transfer rate, but if a solvent removal step is carried out, then the absolute volume of solvent that is to be evaporated off in the transfer unit 18 is only small, and therefore, not only is the condensation effect even more effective, but the thermal load during transfer can also be reduced. Moreover, it is also possible to impart good fixing characteristics and luster to the image, after transfer to the recording medium 34, due to the effective condensation of the ink image by heating in the transfer unit 18.

Furthermore, it is also possible to adjust the temperature and pressure during transfer freely, to suitable conditions, in accordance with the recording medium 34 and the printing conditions, and the like.

Moreover, it is also possible to adopt a structure having a surface layer which has separating properties, according to requirements. If the surface of the transfer body has been imparted with separating properties, then it has low surface energy and high separating properties, and therefore it is possible to achieve a high transfer rate. In the present embodiment, it is possible to obtain a satisfactory transfer rate even if separating properties are not imparted in particular, but from the viewpoint of the cleaning load, and the like, there is no particular problem even if separating properties are imparted to the surface of the intermediate transfer body. Here, a surface having separating properties as referred to in the present embodiment means a surface having a critical surface tension of 30 mN/m or less, or an angle of contact with respect to water of 75° or above.

Desirable materials for use as the surface layer of the intermediate transfer body 12 include, for example, commonly known materials such as: a polyurethane resin, a polyester resin, a polystyrene resin, a polyolefin resin, a polybutadiene resin, a polyamide resin, a polyvinyl chloride resin, a polyethylene resin, a fluorine resin, a polyimide resin, and the like.

The cleaning unit 22 is disposed to the downstream side of the transfer unit 18 in terms of the transfer body rotation direction and to the upstream side of the treatment liquid application unit 14 in terms of the transfer body rotation direction. A cleaning roller 38 is disposed in the cleaning unit 22 on the side adjacent to the recording surface 12*a* of the intermediate transfer body 12, so as to abut against the recording surface 12*a* of the intermediate transfer body 12, and this cleaning roller 38 removes residual material, and the like, left on the recording surface 12*a* of the intermediate transfer body 12 after transfer. Possible modes of the cleaning roller 38 include: a system where the cleaning roller 38 is made of a soft and porous member, and cleans the surface of the intermediate transfer body (recording surface 12*a*) while being impregnated with a cleaning liquid by means of a cleaning liquid application device; a system where a brush is provided on the surface of the roller and dirt on the surface of the intermediate transfer body is removed by the brush while applying cleaning liquid to the surface of the intermediate transfer body; and a system where a flexible blade is provided on the roller surface and the residual materials (the residual traces of the ink image) on the surface of the intermediate transfer body are swept away by this blade; and the like. If the linear speed of the surface of the cleaning roller 38 is set so as to be slower or faster than the linear speed of the surface of the intermediate transfer body, rather than being equal to same, then it is possible to enhance the rate of removing the residual materials. A shearing force is generated on the surface of the intermediate transfer body in accordance with the speed differential between the surface of the cleaning roller 38 and the surface of the intermediate transfer body, and therefore the residual materials can be removed efficiently.

Moreover, a plurality of air nozzles 39 and 39 for ejecting air are provided to the downstream side of the cleaning roller 38 in terms of the transfer body rotation direction (in FIG. 1, two air nozzles are provided along the intermediate transfer body), and the cleaning liquid adhering to the recording surface 12*a* of the intermediate transfer body 12 is removed by the ejected air.

In the present embodiment, it is also possible to provide an image fixing unit 24 separately, according to requirements, in order to impart stronger fixing properties to the recording medium after the ink image on the intermediate transfer body 12 has been transferred to the recording medium 34.

Figure 3A:
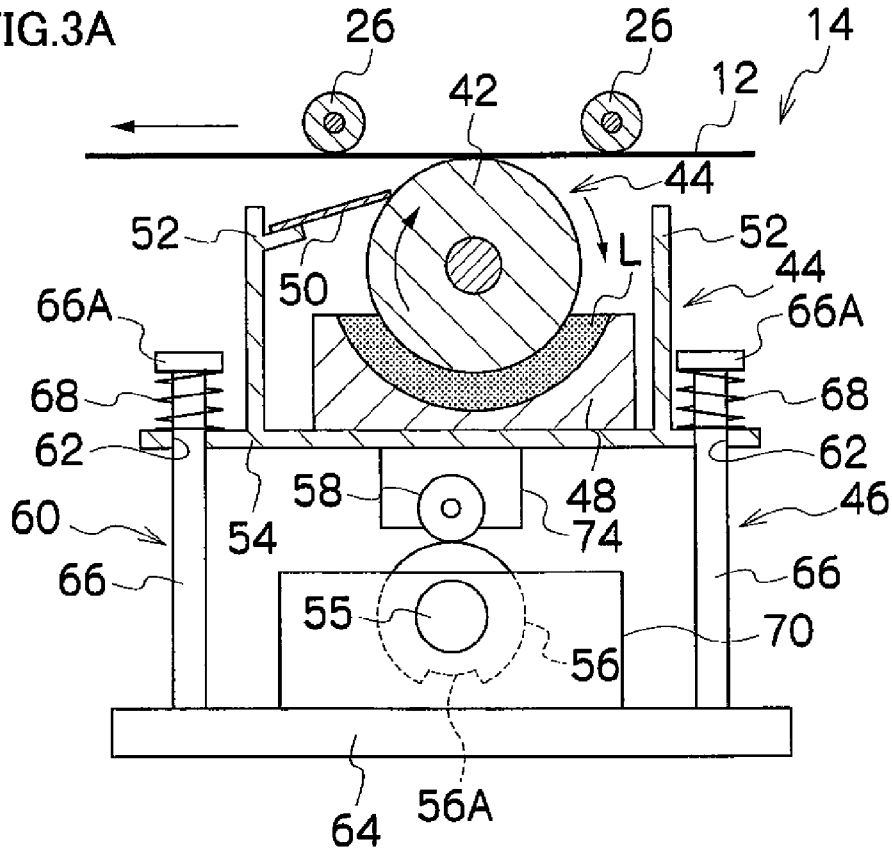
FIGS. 3A and 3B are illustrative diagrams which describe a raising and lowering operation in the first embodiment of the elevator movement apparatus.
Figure 3B:
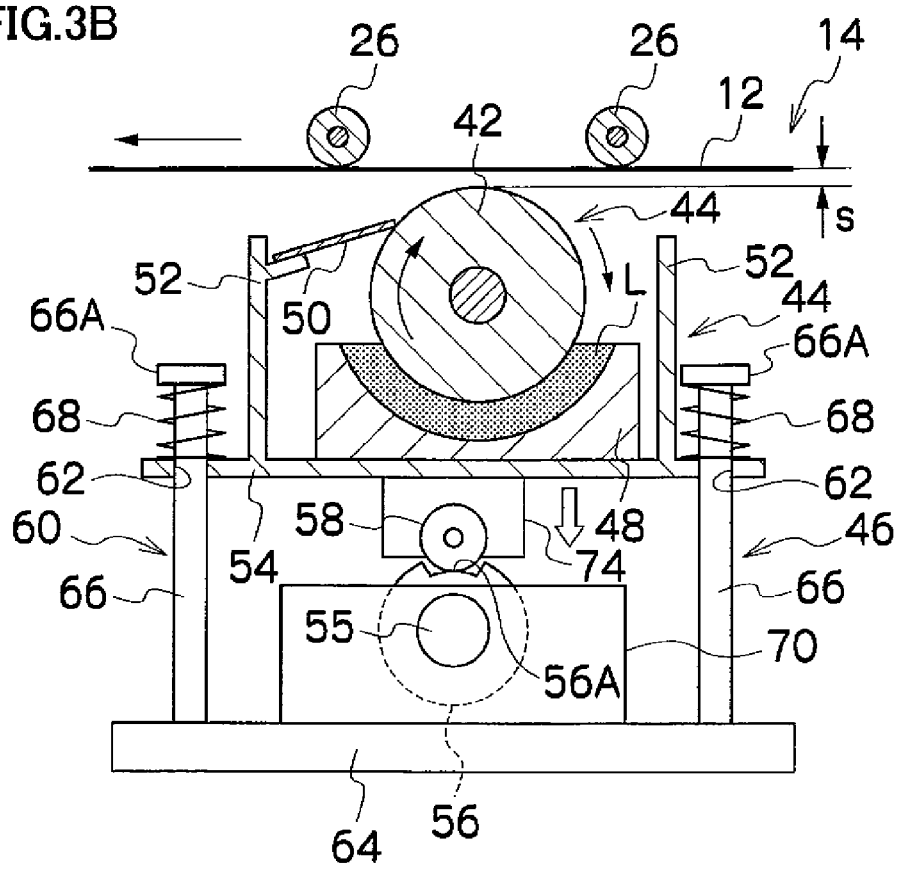

The image fixing unit 24 is disposed on the recording medium output side of the transfer unit 18 (the right-hand side in FIGS. 3A and 3B). In the image fixing unit 24, two fixing rollers 40A and 40B are provided on the front and rear surfaces of the recording medium 34, and by pressurizing and heating the image transferred to and formed on the recording medium 34 by the fixing rollers 40A and 40B, it is possible to improve the fixing properties of the recorded image on the recording medium 34. Desirably, the fixing rollers 40A and 40B are a pair of rollers which comprise one pressurizing and heating roller and one heating roller, but the fixing rollers 40A and 40B are not limited to these.

Structure of Treatment Liquid Application Unit

Next, the structure of the treatment liquid application unit 14 will be described, but particular attention is given here to the description of the elevator movement apparatus 46 used to achieve intermittent application of the treatment liquid to the intermediate transfer body 12. The application cylinder is called an application roller 42.

The treatment liquid application unit 14 principally comprises an application apparatus 44 (also called an application head) which takes up treatment liquid L from a treatment liquid reservoir and applies the treatment liquid L to the intermediate transfer body 12 due to the rotation of the application roller 42, and an elevator movement apparatus 46 which achieves intermittent application of the treatment liquid L onto the intermediate transfer body 12, by raising and lowering the application apparatus 44 or the intermediate transfer body 12 by means of a cam mechanism, and thus causing the intermediate transfer body 12 and the circumferential surface of the application roller 42 to come into contact with each other and separate from each other.

Accordingly, it is possible to apply the treatment liquid L taken up by the rotation of the application roller 42, intermittently, only onto the image regions 12A where the ink image is to be formed on the lower surface of the intermediate transfer body 12.

The application apparatus 44 comprising an application roller 42 which is driven in rotation may be, for example: a direct gravure coater, a reverse gravure coater, an offset gravure coater, a direct bar coater, a kiss coater, a rod coater, an air knife coater, and a five-roll coater, and the like.

In the following description, a treatment liquid application unit 14 using a kiss coater which has a simple structure is described as an example of the application apparatus 44.

First Embodiment of Treatment Liquid Application Unit

Figure 2:
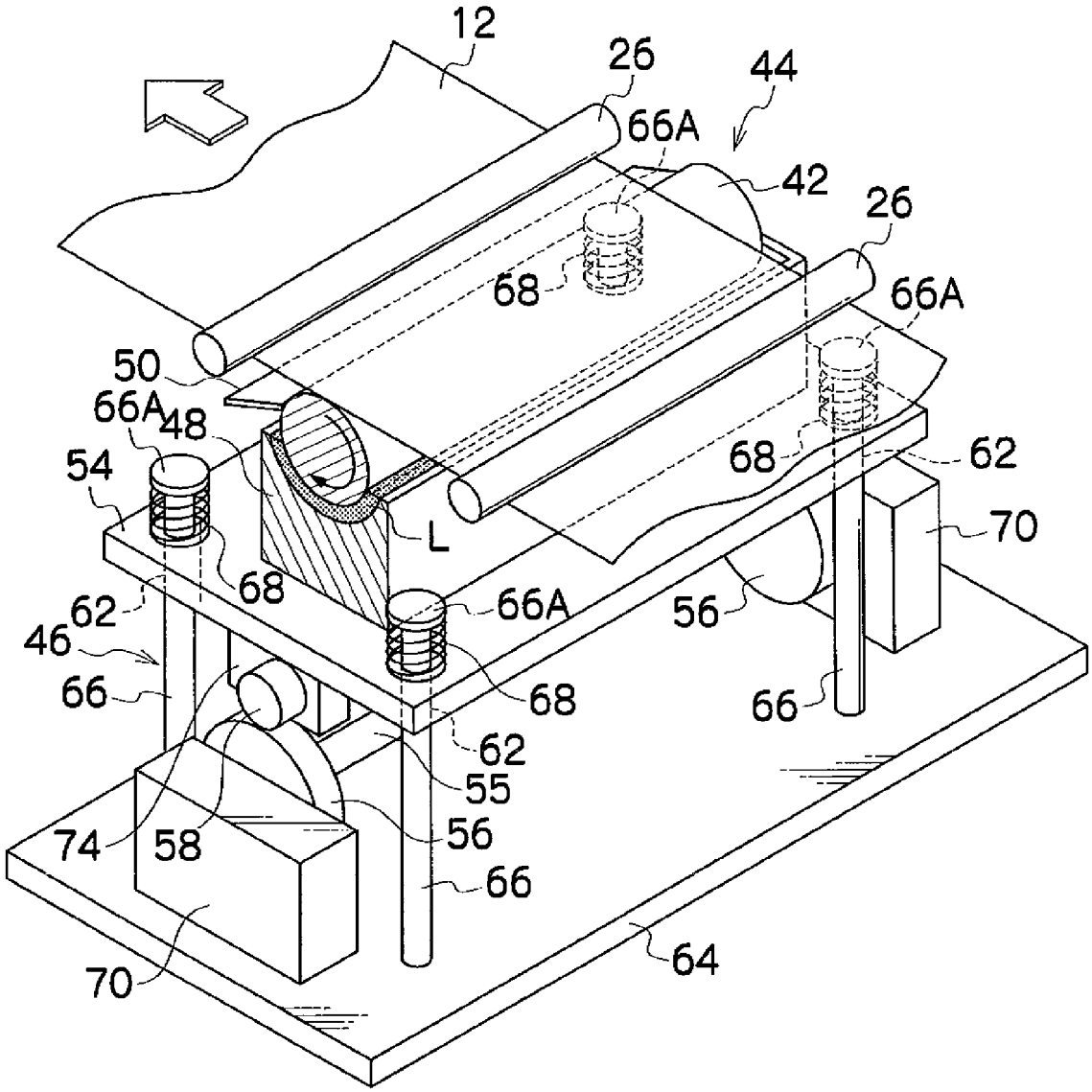
FIG. 2 is a structural diagram of a first embodiment of an elevator movement apparatus, which contacts and separates an application roller with respect to an intermediate transfer body.

FIG. 2 shows a first embodiment of the treatment liquid application unit 14, which applies treatment liquid L intermittently to the intermediate transfer body 12, by raising and lowering a kiss coater 44 with respect to the intermediate transfer body 12 and thereby causing contacting and separating of the intermediate transfer body 12 and the application roller 42.

The treatment liquid application unit 14 principally comprises: a kiss coater 44, and an elevator movement apparatus 46 which raises and lowers the kiss coater 44 with respect to the intermediate transfer body 12 so as to apply treatment liquid L intermittently to the intermediate transfer body 12.

The kiss coater 44 comprises: an application roller 42 which is driven in rotation in the direction of the arrow, by a motor (not shown); a liquid receiving pan 48 (treatment liquid reservoir) which stores treatment liquid L; and a squeegee 50 (also called a blade) which maintains a uniform film thickness of the treatment liquid L on the roller surface by means of the front tip of the blade making contact with the surface of the application roller 42. Inside the liquid receiving pan 48, approximately the lower half of the application roller 42 is immersed in the treatment liquid. Furthermore, the intermediate transfer body 12 is conveyed while being guided by guide rollers 26 and 26, and thereby the intermediate transfer body 12 is conveyed while making contact with the upper surface of the roller 42, when applying treatment liquid. Accordingly, if the application roller 42 rotates, the treatment liquid L inside the liquid receiving pan 48 is taken up onto the application roller 42 due to this rotation, the amount of treatment liquid is adjusted to a prescribed application volume by the squeegee 50, and the treatment liquid is then applied onto the recording surface 12*a* of the intermediate transfer body 12. The treatment liquid L is supplied by a pump from a treatment liquid supply tank (not shown) to the liquid receiving pan 48, and the height of the treatment liquid L in the liquid receiving pan 48 is controlled so as to maintain a uniform height. The side wall 52 (see FIGS. 3A and 3B; not shown in FIG. 2) is formed about the perimeter of the kiss coater 44, thereby preventing the treatment liquid L from flowing out to the exterior.

Furthermore, the elevator movement apparatus 46 principally comprises an elevator plate 54 on which the kiss coater 44 is mounted, a cam mechanism which raises and lowers the elevator plate 54 by means of cam members 56 and cam followers 58, and a guide mechanism 60 which guides the raising and lowering of the elevator plate 54.

The elevator plate 54 is formed in a quadrilateral shape, and has through holes 62 formed respectively in the four corners. On the other hand, the four guide arms 66 are provided respectively in a perpendicular standing fashion on the four corner sections of a base platform 64, and the guide arms 66 are inserted respectively through the four through holes 62 of the elevator plate 54. Thereby, when the raising and the lowering plate 54 is raised or lowered by the cam mechanism, then it is guided by the guide arms 66 and therefore it can be raised and lowered in a stable fashion. Consequently, the application roller 42 of the kiss coater 44 which is mounted on the elevator plate 54 can be placed in contact with the intermediate transfer body 12 and separated from same, by the raising and lowering action of the elevator plate 54. Furthermore, a large-diameter head section 66A is formed on the upper end of each guide arm 66, and a spring 68 is interposed between this head section 66A and the elevator plate 54. Due to the impelling force of these springs 68, it is possible to prevent a shaking motion during the raising or lowering operation of the elevator plate 54, and the raising and lowering operation can be stabilized yet further. The number of guide arms 66 and the number of through holes 62 in the elevator plate 54 are not limited to four.

The cam members 56 are each formed in the shape of large-diameter circular disks, and a cam groove 56A (see FIGS. 3A and 3B) is formed in the circumferential surface thereof The cam members 56 are provided as a pair, at both ends of the cam shaft 55 which are disposed in the breadthways direction of the intermediate transfer body 12 (in parallel with the application roller 42); both ends of the cam shaft 55 are supported rotatably on bearings 70, and these bearings 70 are fixed to the base platform 64. Furthermore, the cam shaft 55 for the cam members 56 is coupled to a motor via a gear reducing device (not shown).

On the other hand, the cam followers 58 are provided as a pair so as to rest in contact with the upper portion of the cam members 56, and each of these rotatable cam followers 58 is supported on a supporting body 74 which is fixed to the lower surface of the elevator plate 54 described above. Each cam follower 58 is formed in the shape of a small-diameter circular disk which is able to drop into the cam groove 56A formed in the cam member 56.

Therefore, the positional relationship between the elevator plate 54, the cam members 56, and the cam followers 58 is such that the cam followers 58 supported on the supporting body 74 are disposed on top of the cam members 56, which are supported on the base platform 64 via the bearings 70, and the elevator plate 54, on which the kiss coater 44 is mounted, is fixed on top of the supporting body 74. When the cam followers 58 are in contact with the cam members 56 at a position which is 180° opposite to the position where the cam groove 56A is formed in each cam member 56, this is called the job start position, and in this job start position, the upper surface of the application roller 42 of the kiss coater 44 is set so as to make contact with the lower surface of the intermediate transfer body 12.

Consequently, when the cam members 56 are driven so as to rotate by means of a motor, and the cam followers 58 make contact with the cam members 56 in a position other than the cam grooves 56A of the cam members 56, as shown in FIG. 3A, then the elevator plate 54 is in a raised state. Therefore, the upper face of the application roller 42 of the kiss coater 44 is in contact with the lower surface of the intermediate transfer body 12, and consequently, treatment liquid L is applied to the intermediate transfer body 12.

Furthermore, when the cam members 56 rotate and the cam grooves 56A reach the positions of the cam followers 58, as shown in FIG. 3B, the cam followers 58 drop by a distance of the stroke s, into the cam grooves 56A. The elevator plate 54 falls in accordance with the dropping action of the cam followers 58, and therefore the application roller 42 is separated instantaneously from the intermediate transfer body 12. Therefore, the application of treatment liquid to the intermediate transfer body 12 is halted. Moreover, when the cam members 56 are rotated further and the cam followers 58 leave the positions of the cam grooves 56A, then the elevator plate 54 is raised and returns to the state in FIG. 3A, and the application of treatment liquid L is started again.

In this way, since the elevator plate 54 on which the kiss coater 44 is mounted is raised and lowered by means of the cam mechanism, then it is possible to achieve highly precise intermittent application in which application is started and halted instantaneously, in accordance with the image regions 12A and the non-image regions 12B of the intermediate transfer body 12, even using an application apparatus which comprises an application roller 42 such as a kiss coater 44. Accordingly, it is possible to apply the treatment liquid L with good accuracy, to the image regions 12A of the intermediate transfer body 12 only. Consequently, it is possible to satisfy the demands of achieving high resolution and high image quality, as well as shortening the drying time for transfer, and it is also possible to avoid wasteful consumption of the treatment liquid, prevent the occurrence of foreign matter, and reduce the cleaning load.

Second Embodiment of the Elevator Movement Apparatus

Figure 4:
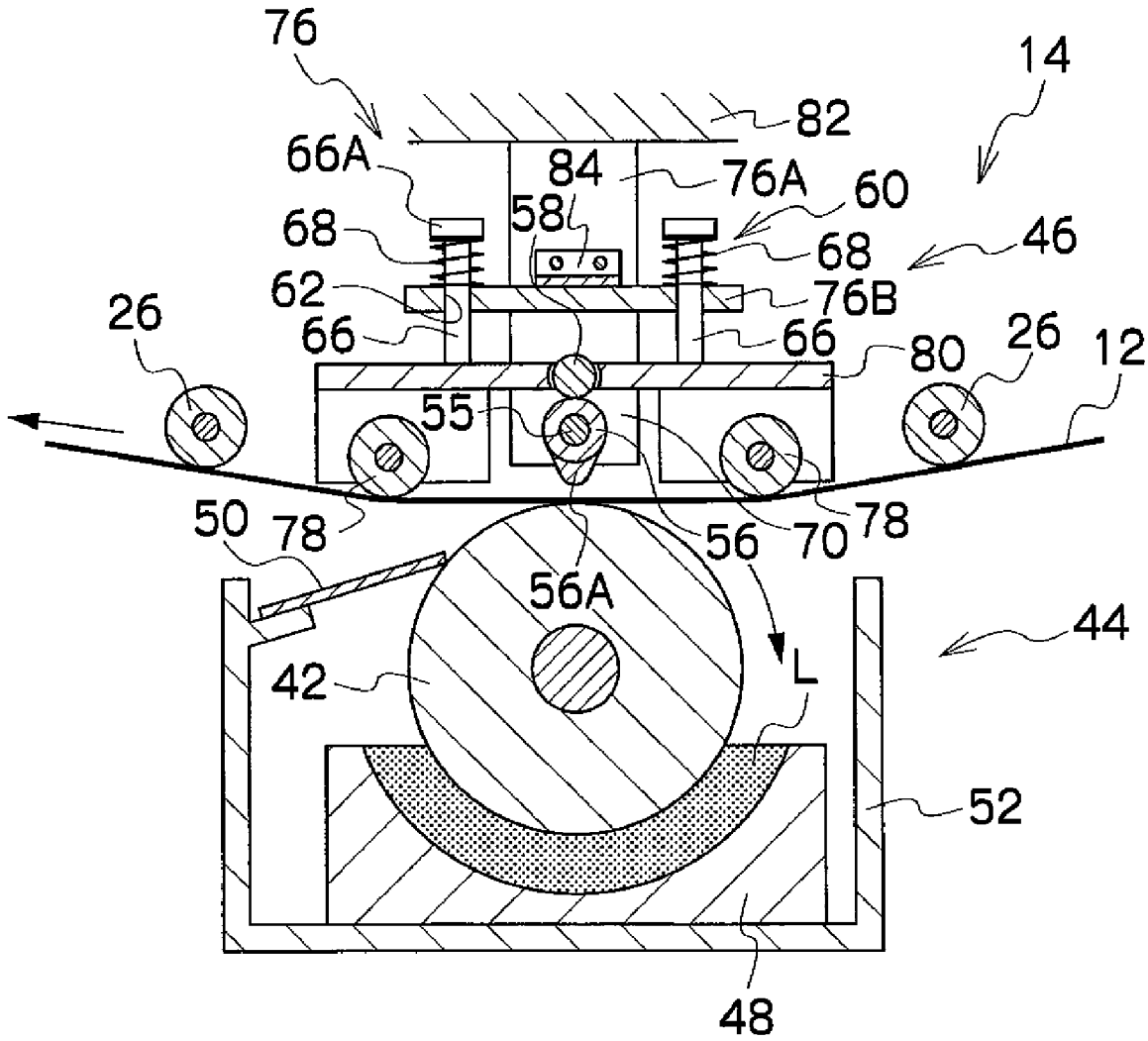
FIG. 4 is a structural diagram of a second embodiment of an elevator movement apparatus, which contacts and separates an intermediate transfer body with respect to an application roller.

FIG. 4 shows a second embodiment of the treatment liquid application unit 14, which applies treatment liquid L intermittently to the intermediate transfer body 12, by raising and lowering the intermediate transfer body 12 with respect to a kiss coater 44 and thereby causing contacting and separating of the intermediate transfer body 12 and the application roller 42. The composition of the kiss coater 44 is the same as that of the first embodiment, and therefore the elevator movement apparatus 46 is described here. Members which are the same as those of the first embodiment are labeled here with the same reference numerals.

The elevator movement apparatus 46 principally comprises: a supporting member 76 which supports the main body of the apparatus above the intermediate transfer body 12; a pair of pressing rollers 78 which press the intermediate transfer body 12 toward the roller 42 of a kiss coater 44; an elevator frame 80 which supports the pressing rollers 78 rotatably; a cam mechanism which raises and lowers the elevator frame 80 by means of cam members 56 and cam followers 58; and a guide mechanism 60 which guides the raising and lowering of the elevator frame 80.

The supporting member 76 is suspended from the ceiling portion 82 of the inkjet recording apparatus, and is constituted by a pair of vertical plates 76A which are disposed in opposing positions on either side of the breadthways direction of the intermediate transfer body 12 (the front/rear direction in terms of the plane of the drawing in FIG. 4), and a horizontal plate 76B which is supported horizontally at the central positions of the pair of vertical plates 76A. The vertical plates 76A and the horizontal plate 76B are coupled together by means of L-shaped brackets 84. Furthermore, the through holes 62 are formed respectively in the four corner sections of the horizontal plate 76B, which is formed in a quadrilateral shape.

The pressing rollers 78 are disposed on the upper surface side of the intermediate transfer body 12, in such a manner that the roller axis lies in the breadthways direction of the intermediate transfer body 12. Moreover, the pressing rollers 78 are provided in a pair on the upstream side and the downstream side of the kiss coater 44, in terms of the direction of travel of the intermediate transfer body 12, and they are supported rotatably on the elevator frame 80.

Four guide arms 66 are erected vertically in the four corner sections on the upper surface of the elevator frame 80, and these guide arms 66 are inserted respectively into the four through holes 62 of the horizontal plate 76B described above. Thereby, when the elevator frame 80 is raised or lowered by the cam mechanism, then it is guided by the guide arms 66 and therefore it can be raised and lowered in a stable fashion. Consequently, the pair of pressing rollers 78 which are supported on the elevator frame 80 can press against the intermediate transfer body 12 and cause same to make contact with the application roller 42 of the kiss coater 44, or they can release this pressing action and cause the intermediate transfer body 12 to separate from the application roller 42, by means of the raising and lowering operation of the elevator frame 82. Furthermore, a large-diameter head section 66A is formed on the upper end of each guide arm 66, and a spring 68 is interposed between this head section 66A and the horizontal plate 76B. Due to the impelling force of these springs 68, a shaking action can be avoided in the raising and lowering of the elevator frame 82, and therefore the raising and lowering operation can be stabilized yet further.

The cam members 56 are each formed in the shape of large-diameter circular disk, and a cam projection 56A is formed in the circumferential surface thereof. The cam members 56 are provided as a pair in the respective end portions of the cam shaft 55, which is disposed in the breadthways direction of the intermediate transfer body 12 (in parallel with the application roller 42). Either end of the cam shaft 55 is supported rotatably on a bearing 70, and these bearings 70 are supported on the lower end portions of the vertical plates 76A. Furthermore, the cam shaft 55 for the cam members 56 is coupled to a motor via a gear reducing device (not shown).

On the other hand, the cam followers 58 are provided as a pair so as to rest in contact with the upper portion of the cam members 56, and each of the rotatable cam followers 58 is supported on the elevator frame 80 described above.

Therefore, the positional relationship between the pair of pressing rollers 78, the cam members 56 and the cam followers 58 is such that the cam followers 58 which are supported on the elevator frame 80 are disposed above the cam members 56 which are supported on the vertical plates 76A, and the pair of pressing rollers 78 are supported on the elevator frame 80. When the cam followers 58 are in contact with the cam members 56 at a position which is 180° opposite to the position where the cam projection 56A is formed in each cam member 56, this is called the job start position, and the pair of pressing rollers 78 are set in such a manner that in this job start position, the intermediate transfer body 12 is caused to make contact with the application roller 42 of the kiss coater 44.

Figure 5A:
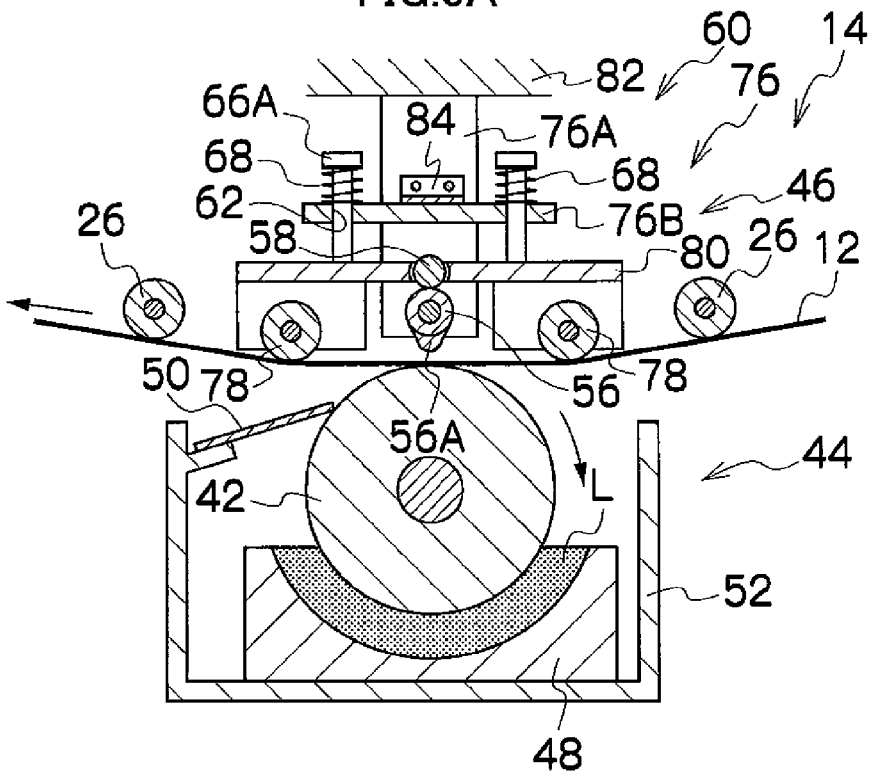
FIGS. 5A and 5B are illustrative diagrams which describe a raising and lowering operation in the second embodiment of the elevator movement apparatus.
Figure 5B:
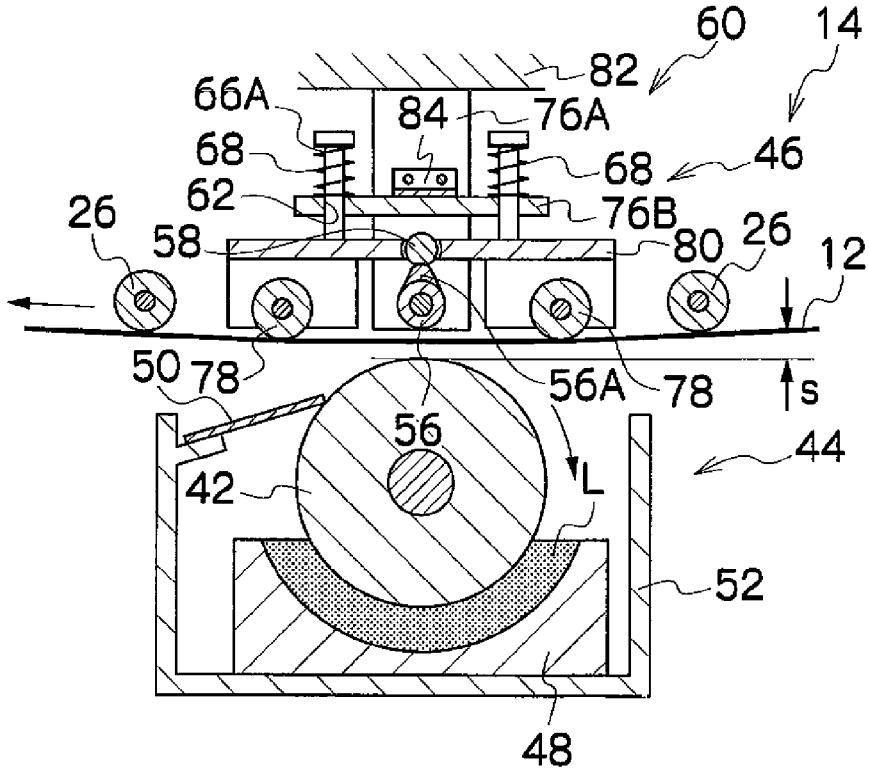

Consequently, when the cam members 56 are driven so as to rotate by means of a motor, and the cam followers 58 make contact with the cam members 56 in a position other than the cam projections 56A of the cam members 56, as shown in FIG. 5A, then the pressing rollers 78 are in a lowered state and they press against the intermediate transfer body 12. Therefore, the intermediate transfer body 12 makes contact with the application roller 42 of the kiss coater 44 and treatment liquid is applied to the intermediate transfer body 12. Furthermore, when the cam members 56 rotate and the cam projections 56A reach the positions of the cam followers 58, as shown in FIG. 5B, the cam followers 58 are caused to project out (to be raised) by the distance of the stroke s, by means of the cam projections 56A. By this means, the pair of pressing rollers 78 are raised instantaneously via the elevator frame 80, and the pressing action against the intermediate transfer body 12 is released. Consequently, the intermediate transfer body 12 is separated from the application roller 42 of the kiss coater 44, and therefore the application of treatment liquid L to the intermediate transfer body 12 is halted. Moreover, when the cam members 56 are rotated father and the cam followers 58 leave the positions of the cam projections 56A, then the elevator frame 80 is lowered and returns to the state in FIG. 5A, and the application of treatment liquid L is started again.

In this way, since the elevator frame 80 which supports the pair of pressing rollers 78 is raised and lowered by means of the cam mechanism, then it is possible to achieve highly precise intermittent application in which application is started and halted instantaneously, in accordance with the image regions 12A and the non-image regions 12B of the intermediate transfer body 12, even using an application apparatus which comprises an application roller 42 such as a kiss coater 44. Accordingly, it is possible to apply the treatment liquid L with good accuracy, to the image regions of the intermediate transfer body 12 only. Consequently, it is possible to satisfy the demands of achieving high resolution and high image quality, as well as shortening the drying time for transfer, and it is also possible to avoid wasteful consumption of the treatment liquid L, prevent the occurrence of foreign matter, and reduce the cleaning load.

Third Embodiment of the Elevator Movement Apparatus

Figure 6:
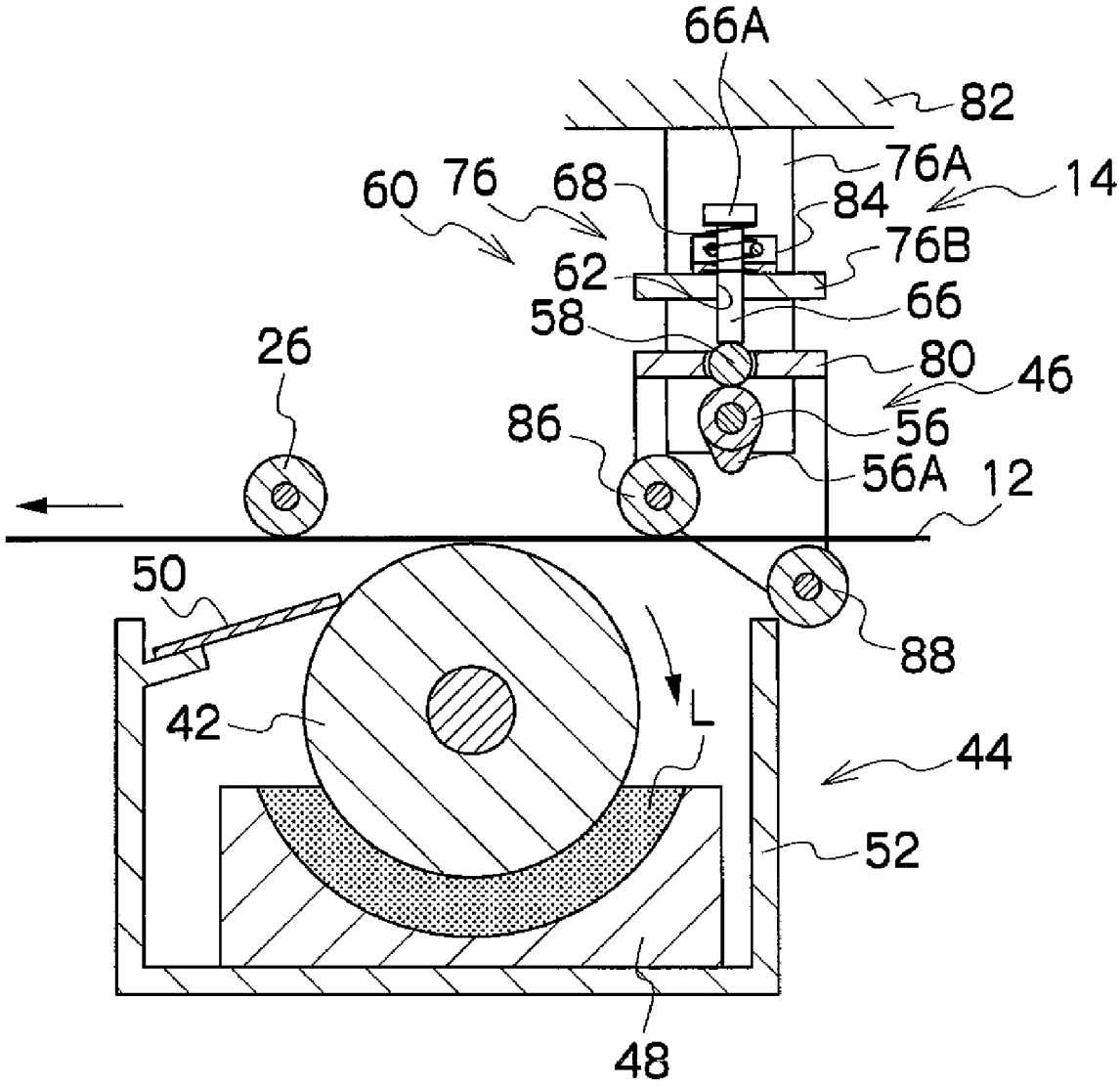
FIG. 6 is a structural diagram of a further mode, being a third embodiment of an elevator movement apparatus, which contacts and separates an intermediate transfer body with respect to an application roller.

FIG. 6 shows a third embodiment of the treatment liquid application unit 14, being a modification of the second embodiment, which applies treatment liquid L intermittently to the intermediate transfer body 12, by raising and lowering the intermediate transfer body 12 with respect to a kiss coater 44 and thereby causing contacting and separating of the intermediate transfer body 12 and the application roller 42. Members which are the same as those of the first and second embodiments are labeled here with the same reference numerals.

The elevator movement apparatus 46 principally comprises: a supporting member 76 which supports the main body of the apparatus above the intermediate transfer body 12; an upper side roller 86 which contacts the upper surface side of the intermediate transfer body 12; a lower side roller 88 which contacts the lower surface side of the intermediate transfer body 12; an elevator frame 80 which supports the upper and lower rollers 86 and 88 in a rotatable fashion; a cam mechanism which raises and lowers the elevator frame 80 by means of cam members 56 and cam followers 58; and a guide mechanism which guides the raising and lowering the elevator frame 80.

Similarly to the second embodiment, the supporting member 76 is suspended from the ceiling portion 82 of the inkjet recording apparatus, and is constituted by a pair of vertical plates 76A which are disposed in opposing positions on either side in the breadthways direction of the intermediate transfer body 12 (the front/rear direction in terms of the plane of the drawing in FIG. 6), and a horizontal plate 76B which is supported horizontally at the central positions of the pair of vertical plates 76A. The vertical plates 76A and the horizontal plate 76B are coupled together by means of L-shaped brackets 84. Furthermore, two through holes 62 (in the front/rear direction of the plane of the drawing in FIG. 6) are formed in the horizontal plate 76B, which is formed in a quadrilateral shape.

The upper side roller 86 is disposed on the upper surface side of the intermediate transfer body 12, in such a manner that the roller axis lies in the breadthways direction of the intermediate transfer body 12. Furthermore, the lower side roller 88 is disposed on the lower surface side of the intermediate transfer body 12, in such a manner that the roller axis lies in the breadthways direction of the intermediate transfer body 12. The upper side and lower side rollers 86 and 88 are provided on the upstream side of the kiss coater 44 in terms of the direction of travel of the intermediate transfer body 12, and they are supported rotatably on the elevator frame 80. The upper side and lower side rollers 86 and 88 can also be disposed on the supporting member 76 or the elevator frame 80 so as to be provided on the downstream side of the kiss coater 44.

Two guide arms 66 (in the front/rear direction with respect to the plane of the drawing in FIG. 6) are erected vertically on the upper surface of the elevator frame 80, and these guide arms 66 are inserted respectively into through holes 62 in the horizontal plate 76B described above. Thereby, when the elevator frame 80 is raised or lowered by the cam mechanism, then it is guided by the guide arms 66 and therefore it can be raised and lowered in a stable fashion. Consequently, when the elevator frame 80 is raised, the lower side roller 88 raises up the intermediate transfer body 12, and therefore the intermediate transfer body 12 is separated from the application roller 42 of the kiss coater 44, whereas when the elevator frame 80 is lowered, the upper side roller 86 presses against the intermediate transfer body 12, and therefore the intermediate transfer body 12 is abutted against the application roller 42 of the kiss coater 44. Furthermore, a large-diameter head section 66A is formed on the upper end of each guide arm 66, and a spring 68 is interposed between this head section 66A and the horizontal plate 76B. Due to the impelling force of these springs 68, a shaking action can be avoided in the raising and lowering of the elevator frame 80, and therefore the raising and lowering operation can be stabilized yet further.

The cam members 56 and the cam followers 58 are similar to those of the second embodiment, and description thereof is omitted here. The positional relationship between the upper side and lower side rollers 86 and 88, the cam members 56 and the cam followers 58 is such that the cam followers 58 which are supported on the elevator frame 80 are disposed on the cam members 56 which are supported on the vertical plates 76A, and the upper side and lower side rollers 86 and 88 are supported on the elevator frame 80. When the cam followers 58 are in contact with the cam members 56 at a position which is 180° opposite to the position where the cam projection 56A is formed in each cam member 56, this is called the job start position, and the upper side and lower side rollers 86 and 88 are adjusted in such a manner that in this job start position, the intermediate transfer body 12 is caused to make contact with the application roller 42 of the kiss coater 44.

Figure 7A:
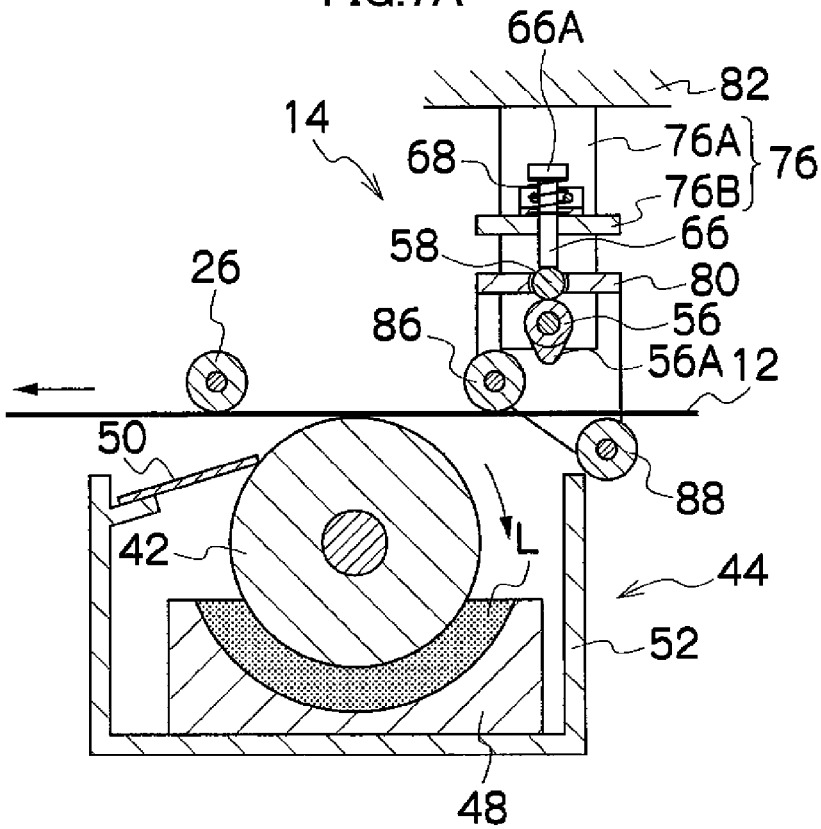
FIGS. 7A and 7B are illustrative diagrams which describe a raising and lowering operation in the third embodiment of the elevator movement apparatus.
Figure 7B:
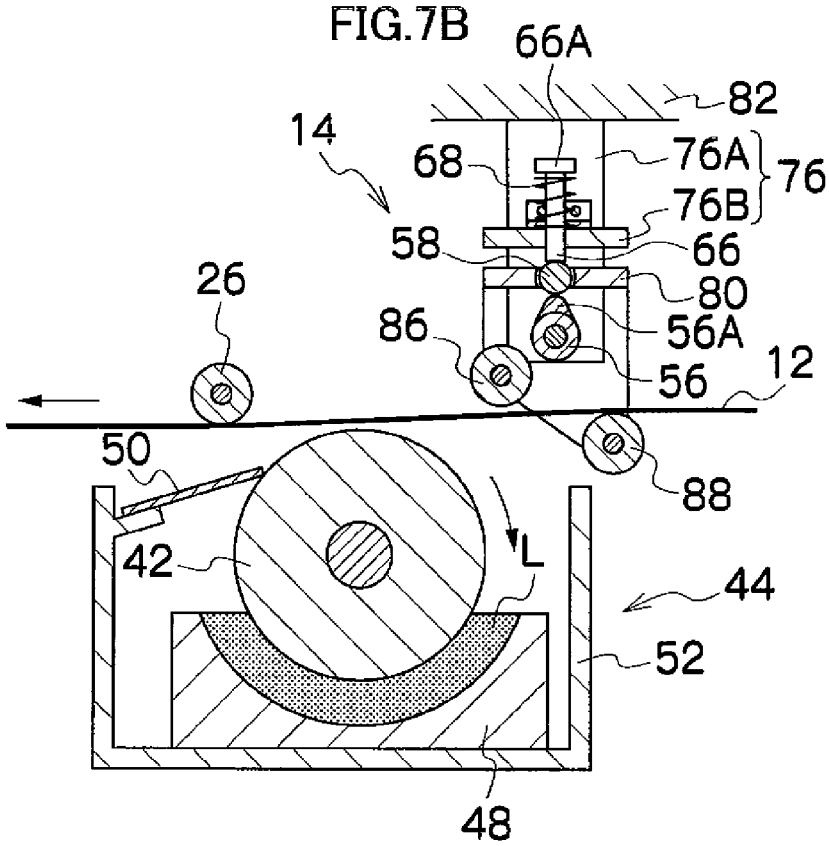

Consequently, when the cam members 56 are driven so as to rotate by means of a motor, and the cam followers 58 make contact with the cam members 56 in a position other than the cam projection 56A of the cam member 56, as shown in FIG. 7A, then the intermediate transfer body 12 is pressed by the upper side roller 86. Therefore, the intermediate transfer body 12 makes contact with the application roller 42 of the kiss coater 44 and treatment liquid L is applied to the intermediate transfer body 12. Furthermore, when the cam members 56 rotate and the cam projections 56A reach the positions of the cam followers 58, as shown in FIG. 7B, the cam followers 58 are caused to project out by the distance of the stroke s, by means of the cam projections 56A. Therefore, the lower side roller 88 instantaneously raises the intermediate transfer body 12 via the elevator frame 80, and therefore the intermediate transfer body 12 is separated from the application roller 42 of the kiss coater 44, and the application of treatment liquid L to the intermediate transfer body 12 is halted. Moreover, when the cam members 56 are rotated further and the cam followers 58 leave the positions of the cam projections 56A, then the elevator frame 80 is lowered and returns to the state in FIG. 7A, and the application of treatment liquid L is started again.

In this way, since the elevator frame 80 which supports the upper side and lower side rollers 86 and 88 is raised and lowered by means of the cam mechanism, then it is possible to achieve highly precise intermittent application in which application is started and halted instantaneously, in accordance with the image regions 12A and the non-image regions 12B of the intermediate transfer body 12, even with an application apparatus which comprises an application roller 42 such as a kiss coater 44. Accordingly, it is possible to apply the treatment liquid with good accuracy, to the image regions of the intermediate transfer body 12 only. Consequently, it is possible to satisfy the demands of achieving high resolution and high image quality, as well as shortening the drying time for transfer, and it is also possible to avoid wasteful consumption of the treatment liquid L, prevent the occurrence of foreign matter, and reduce the cleaning load.

The first to third embodiments described above related to a one-cycle method, in which one cam groove 56A or one cam projection 56A is formed in each cam member 56, and one raising and lowering operation of the elevator plate 54 or elevator frame 80 is perform in each revolution of the cam member 56.

Figure 8A:
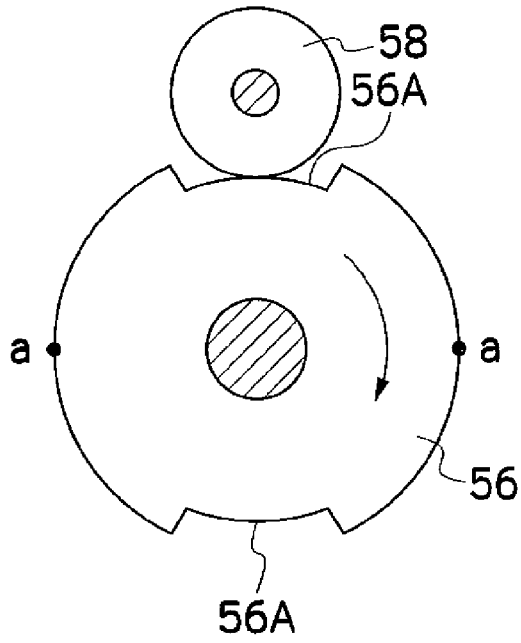
FIGS. 8A and 8B are illustrative diagrams which describe a two-cycle system of a cam mechanism.
Figure 8B:
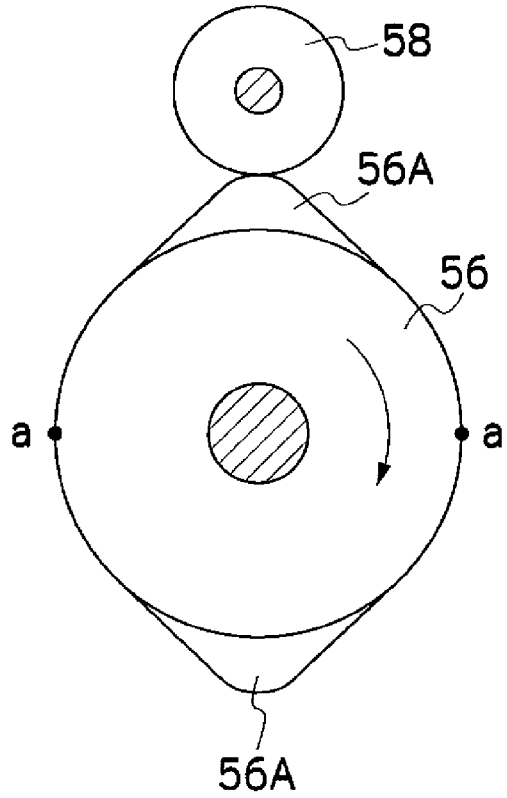

However, as shown in FIGS. 8A and 5B, it is also possible to form a plurality of cam grooves 56A or a plurality of cam projections 56A. FIGS. 8A and 8B show a two-cycle system in which the elevator plate 54 performs two raising and lowering actions with each revolution of the cam members 56, and here, the job start positions are the intermediate positions, "a", which are furthest from the two cam grooves 56A or the two cam projections 56A.

Concrete Example of the Intermittent Operation of the Elevator Movement Apparatus Next, one example of intermittently applying treatment liquid L to an intermediate transfer body 12 will be described in concrete terms.

Figure 13A:
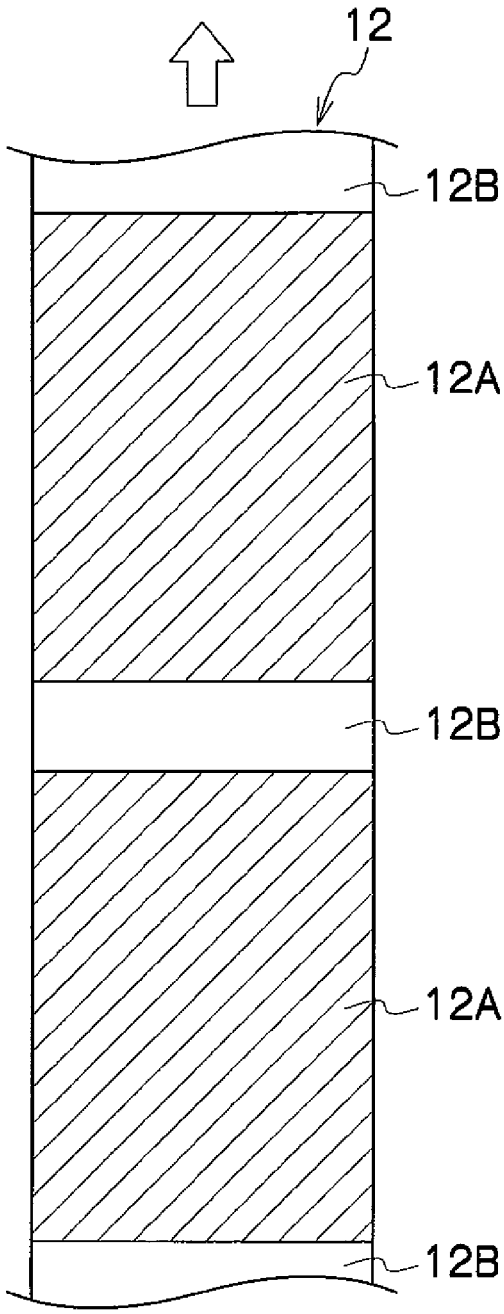
FIGS. 13A and 13B are illustrative diagrams which describe examples of image regions and non-image regions 12B according to an embodiment of the present invention.

The concrete example of intermittent application described here is one where recording media 34 such as cut-sheet paper are supplied to the transfer unit 18 at a uniform spacing apart, and as shown in FIG. 13A, the treatment liquid L is not applied to the non-image regions 12B (white portions in FIG. 13A) of the intermediate transfer body 12, which are the regions between the recording media 34 where no recording medium 34 is present.

In one such example, the following operating conditions are set and these operating conditions are input to a CPU (central processing unit) which controls the driving of the inkjet recording apparatus.

(1) Conveyance speed V of intermediate transfer body 12=500 mm/sec (2) Length Lm of recording medium 34 supplied to transfer unit 18=520 mm (3) Spacing Ls between recording media 34 supplied to transfer unit 18=20 mm (4) Number of sheets printed per second From the above conditions of (1), (2), (3), 500/(520+20)=0.93 sheet/sec (5) Printing cycle time=(520+20)/500=1.08 sec (6) Separation time (tc) for separating intermediate transfer body 12 from application roller 42.

Here, the separation time depends on the spacing between the sheets of recording media 34 which are supplied to the transfer unit 18 and the conveyance speed of the intermediate transfer body 12, and therefore tc=20/500×1000=40 msec.

(7) Separation stroke s by which intermediate transfer body 12 and application roller 42 are separated=2 mm (8) The raising time ta for raising the cam followers 58 with respect to the cam members 56 and the lowering time td for lowering same, in order to achieve a separation stroke of 2 mm between the intermediate transfer body 12 and the application roller 42, satisfy the following: ta=td=20 msec.

In the first embodiment described above, the cam followers 58 in the cam mechanism perform a cycle of a lowering action→separated state→raising action, with respect to the cam members 56. In the second and third embodiments described above, the cam followers 58 perform a cycle of a raising action→separated state→lowering action, with respect to the cam members 56.

Figure 9:
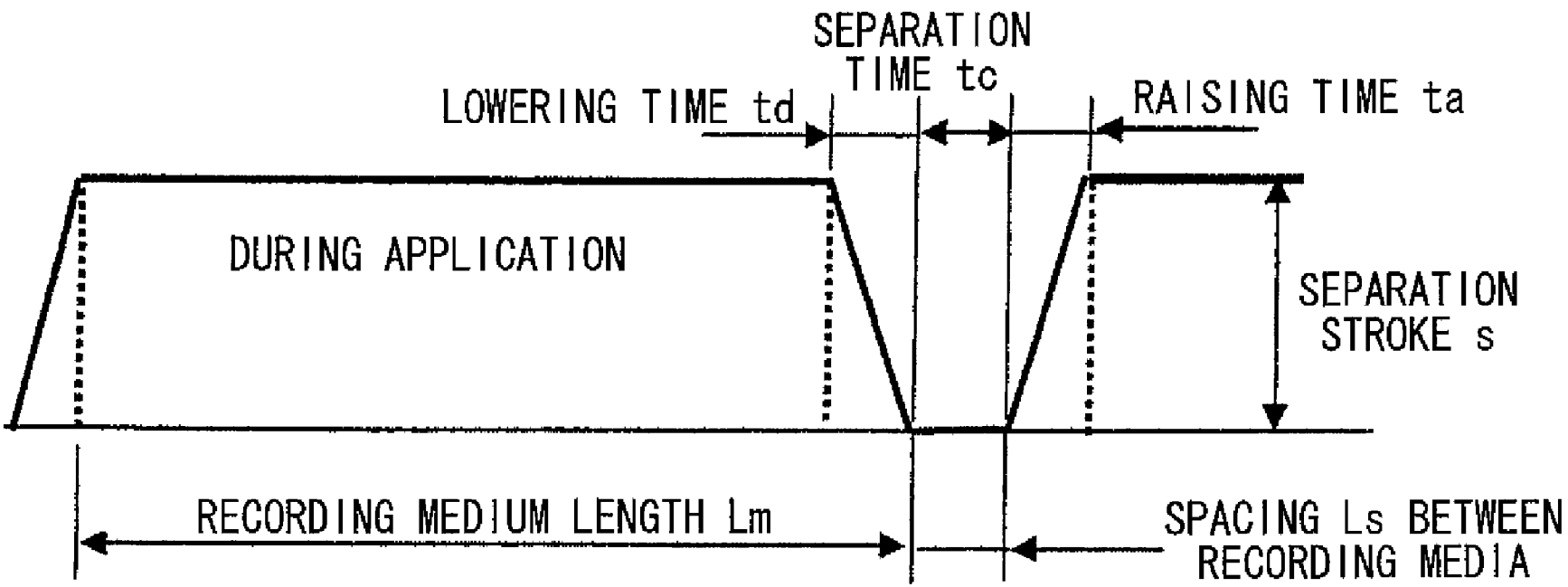
FIG. 9 is a displacement characteristics diagram which shows the temporal displacement of a cam follower constituting a cam mechanism.

FIG. 9 is a displacement characteristics diagram which shows the temporal displacement of the cam followers 58 in the first embodiment. The vertical axis in FIG. 9 indicates the amount of displacement of the cam followers 58, and the horizontal axis indicates the conveyance distance of the intermediate transfer body 12 which corresponds to the length Lm of the recording medium and the spacing Ls between the sheets of recording media.

Figure 10:
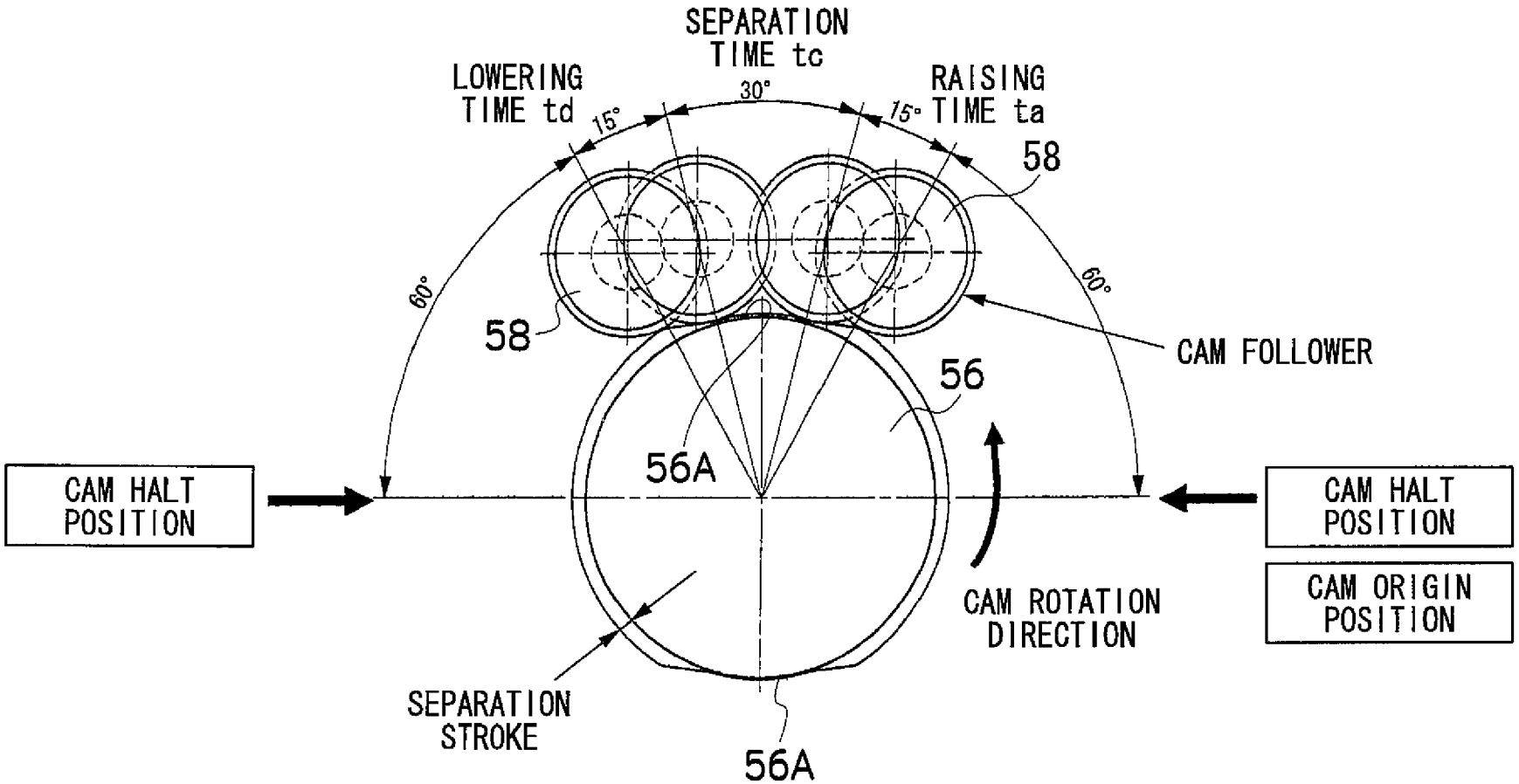
FIG. 10 is a diagram which shows the lowering→separation→raising action cycle of a cam follower in relation to the angle of rotation of a cam member.

Furthermore, FIG. 10 shows a cycle of the lowering→separation→raising actions of the cam followers in relation to the angle of rotation of the cam members 56.

In the case of the first embodiment, the cam followers 58 perform a raising and lowering action due to the rotation of the cam members 56, while receiving the weight of the kiss coater 44 which is mounted on the elevator plate 54, and the impelling force of the spring. FIG. 10 shows an example of the two-cycle system in FIG. 8A, in which the cam followers 58 perform two raising and lowering actions in one revolution of the cam members 56. In this case, the angle of rotation of one cycle is 180°, and the job start position is the "cam origin position" on the right-hand side in FIG. 10. Furthermore, the angle of rotation which corresponds to the separation time tc is 30°, and the angles of rotation which correspond to the lowering time td and the raising time ta are each 15°, respectively.

FIGS. 11A to 11F show respective steps of transferring from an application state where the application 42 of the kiss coater 44 lies in contact with the intermediate transfer body 12, to an application halt state where the kiss coater 44 is separated from the intermediate transfer body 12, and back again to an application state where the kiss coater 44 is placed in contact with the intermediate transfer body 12, based on the premise that the separation time tc, the lowering time td, and the raising time ta correspond to the angles of rotation described above. FIGS. 11A to 11F show a case where the cam member 56 rotates in the counter-clockwise direction.

Figure 11A:
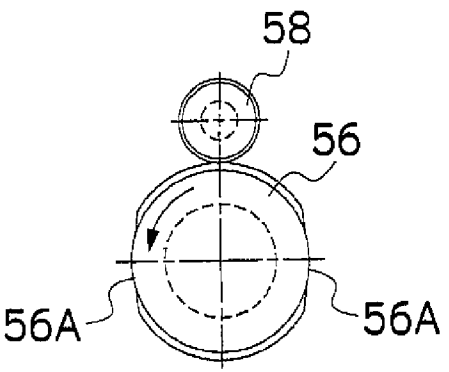
FIGS. 11A to 11F show steps of transferring from an application state where an application roller lies in contact with the intermediate transfer body, to an application halt state where the application roller is separated, and then starting application again.

In the "cam origin position" where the rotation of the cam member 56 in FIG. 11A has been halted, the cam follower 58 contacts a position outside the cam groove 56A of the cam member 56, and therefore the cam follower 58 is in a raised state. Consequently, the intermediate transfer body 12 and the application roller 42 lie in mutual contact, and application of treatment liquid L to the intermediate transfer body 12 is in progress.

The CPU activates the motor from this idle state, so as to cause the cam member 56 to rotate.

Figure 11B:
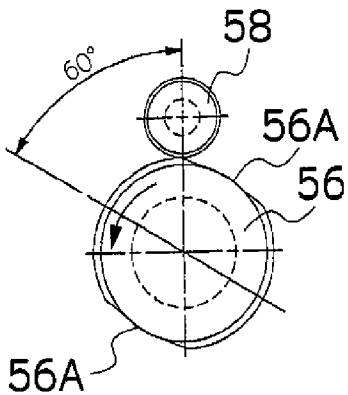

Thereupon, in FIG. 11B, when the cam member 56 has rotated by 60°, in other words, when the cam follower 58 has reached the entrance to the cam groove 56A of the cam member 56, then the CPU ends the activation of the motor and sets the motor to a designated number of revolutions (a uniform speed of rotation). Here, ending activation of the motor means the acceleration from zero speed until reaching the designated speed of revolution. Thereupon, the cam member 56 is rotated and a lowering action of the cam follower 58 is started.

When this activation is ended, the cam member 56 will have been accelerated to a designated speed of rotation. Due to this acceleration of the speed of rotation, it is possible to achieve an extremely short separation time to such as 40 msec described above, in FIG. 11C and FIG. 11D, which are described below.

If the separation time tc is 40 msec, then the time Tc corresponding to one revolution of the cam member 56 is: Tc=separation time tc×360°/angle of rotation=40×360/30=0.48 sec, and the rotational speed of the cam member, Nc, is: Nc=60/Tc=60/0.48=125 rpm.

However, in the two-cycle system, the member should rotate by 180° in one cycle, and therefore the rotational speed Nc of the cam member 56 can be reduced to a low speed of 63 rpm.

In other words, in order that the separation time tc is 40 msec in the two-cycle system, then the rotational speed Nc of the cam member 56 must be accelerated to 63 rpm by the rotation of 60° C. in step (b).

Since the activation interval of the cam member 56 is 1.08 sec, which is the same as the printing cycle time described above, then 1.08−(lowering time+separation time+raising time)=1.08−(0.02+0.04+0.02)=1.0 sec is ensured at a maximum for the acceleration and deceleration. In other words, the acceleration time during activation is one half of 1.0 sec, which is 0.5 seconds. Normally, it is desirable that the specifications of the drive unit should be set so as to allow a spare margin, in such a manner that the actual activation time is shorter than his time.

Figure 11C:
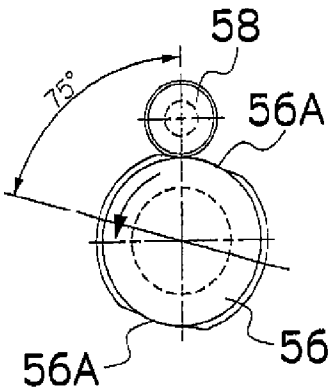
Figure 11D:
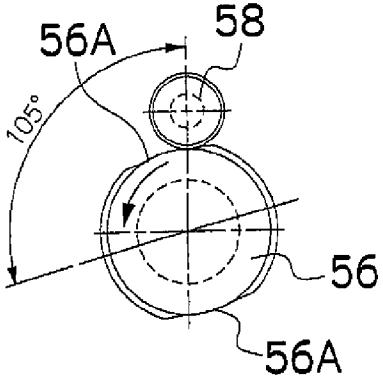

Next, in FIG. 11C, when the cam member 56 is rotated further by 150 (to give a total angle of rotation of 750), the earn follower 58 ends the lowering operation, falls into the cam groove 56A and starts a separating operation. Thereby, the application roller 42 is separated from the intermediate transfer body 12, and therefore application is halted. In FIG. 11D, when the cam member is rotated further by 30° (to give a total angle of rotation of 105°), the separating operation is ended, and the raising operation of the cam follower 58 is started.

Figure 11E:
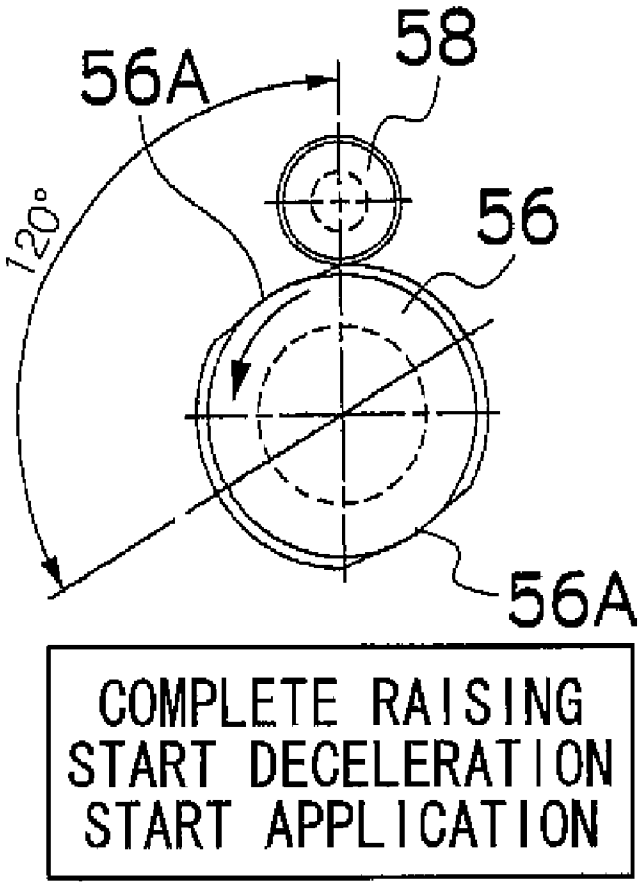

Next, in FIG. 11E, when the cam member is rotated further by 15° (to give a total angle of rotation of 120°), the cam follower 58 ends the raising operation, and exits from the cam groove 56A. By this means, application is restarted.

Figure 11F:
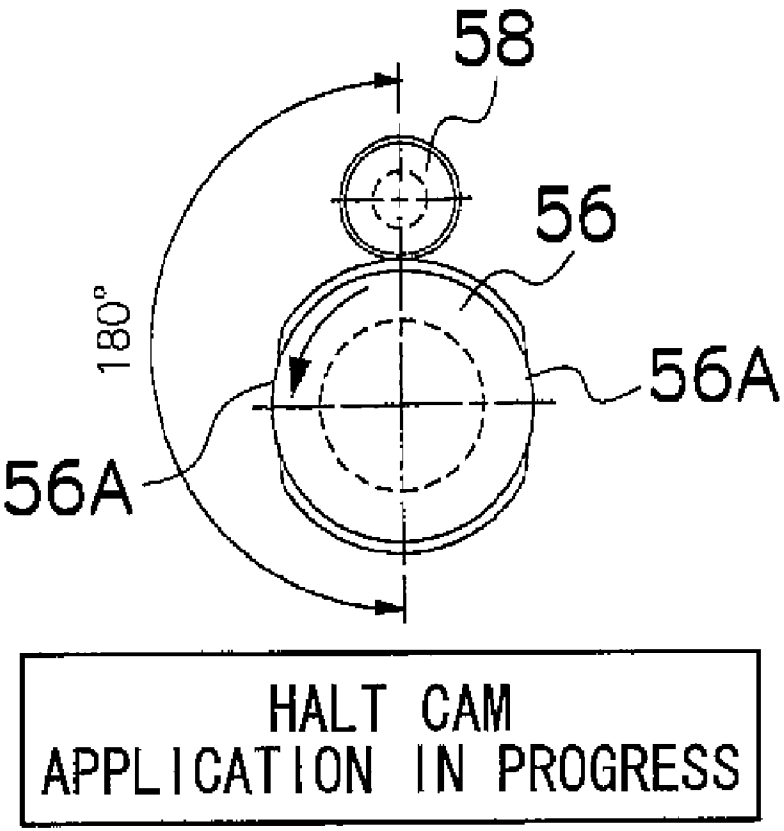

Thereupon, in FIG. 11F, the rotation of the cam member 56 is decelerated until the cam member has rotated by 60° (to give a total angle of rotation of 120°), and the cam member is halted at the "cam halt position" shown in FIG. 10. With this 60° angle of rotation, it is possible to guarantee a distance for decelerating the speed of rotation of the cam member 56.

According to FIGS. 11A to 11F described above, the first cycle of the two cycles is terminated, and the "cam halt position" becomes the "start position" of the second cycle, and the steps in (a) to (f) are repeated. It is desirable that the application roller 42 should be rotated at all times during this operation of intermittent application. Due to this constant rotation, a film of treatment liquid having a uniform thickness is formed at all times on the surface of the application roller 42, and therefore it is possible to transfer the actions instantaneously from halting of application and restarting of application, and furthermore, it is possible to apply treatment liquid L having a uniform film thickness to the intermediate transfer body 12, at all times.

In this way, in the intermittent application implemented in the present embodiment, it is necessary to accelerate the speed of rotation of the cam members 56 in order that the separation time (non-application time) in which the intermediate transfer body 12 and the application roller 42 do not make contact with each other is an extremely short momentary time of 40 msec as described above, but it is possible to achieve this by setting a large angle of rotation from the "cam origin position" until the cam groove 56A.

Benefits of intermittent application using the cam mechanism according to the present embodiment can be stated as follows.

Since the activation of the motor which rotates the cam members 56 is carried out in a division (step a to step b) in which the weight of the application apparatus (for example, the kiss coater 44) does not exert inertia in the gravity direction, then the activation load is smaller than a case where the raising or lowering operation of the application apparatus is carried out simultaneously with the activation of the cam members 56. Furthermore, by making the activation time longer than the raising or lowering time of the application apparatus, it is possible to reduce the motor capacity or to shorten the activation time used to drive rotation of the cam members 56. Moreover, when the application apparatus carries out a lowering and raising operations after the cam members 56 have reached the designated speed of rotation, then it is possible to expect a flywheel effect of the cam members 56 during the lowering and raising operations, and therefore the rotational load on the cam members 56 can be reduced even if the application apparatus is heavy.

By adopting a two-cycle system in which one cycle operation of the cam members is carried out in one half of a revolution, the number of revolution of the cam members 56 is reduced, the speed reduction ratio (deceleration ratio) of the drive mechanism is increased, and therefore the motor torque is lowered.

Desirably, the halt position and the origin signal of the cam members 56 are determined by means of a slit plate and photointerruptor, or the like, and a stepping motor or a servo motor equipped with an encoder is used as the drive motor. By this means, it is possible to raise the accuracy of the angle of rotation, in other words, the separation accuracy. In this case, when the power supply is switched on, the origin position is determined according to the initial settings, and the apparatus then transfers to the next operation. Furthermore, it is also possible to implement control by providing a separation position determination mechanism, in the case of separation over a long period of time (separation during a halt in operation).

Since the actual separation is carried out during the raising or lowering operation of the cam follower 58, then desirably, the actual application interval is measured and any discrepancy is adjusted by altering the rotational speed (rotational number) of the cam. If it exceeds the adjustment region, then it is desirable to adjust the interval by changing the cam shape.

Inkjet Recording Method

Thereupon, the operational sequence of the respective units in the inkjet recording method according to the present embodiment is described with reference to the control timing chart of FIG. 12. The positions of the respective units, such as the treatment liquid application unit 14, the ink ejection unit 16, the transfer unit 18, the solvent removal unit 20, the cleaning unit 22, and the like, are determined by taking the point of origin of the intermediate transfer body 12 as a reference point. The operating times of the respective units are determined with reference to the conveyance speed V of the intermediate transfer body 12. Furthermore, the conveyance speed of the intermediate transfer body 12, the length of the recording medium 34, the details of the ejection of the recording liquid, and the like, are instructed in accordance with the print job, by the CPU.

Figure 12:
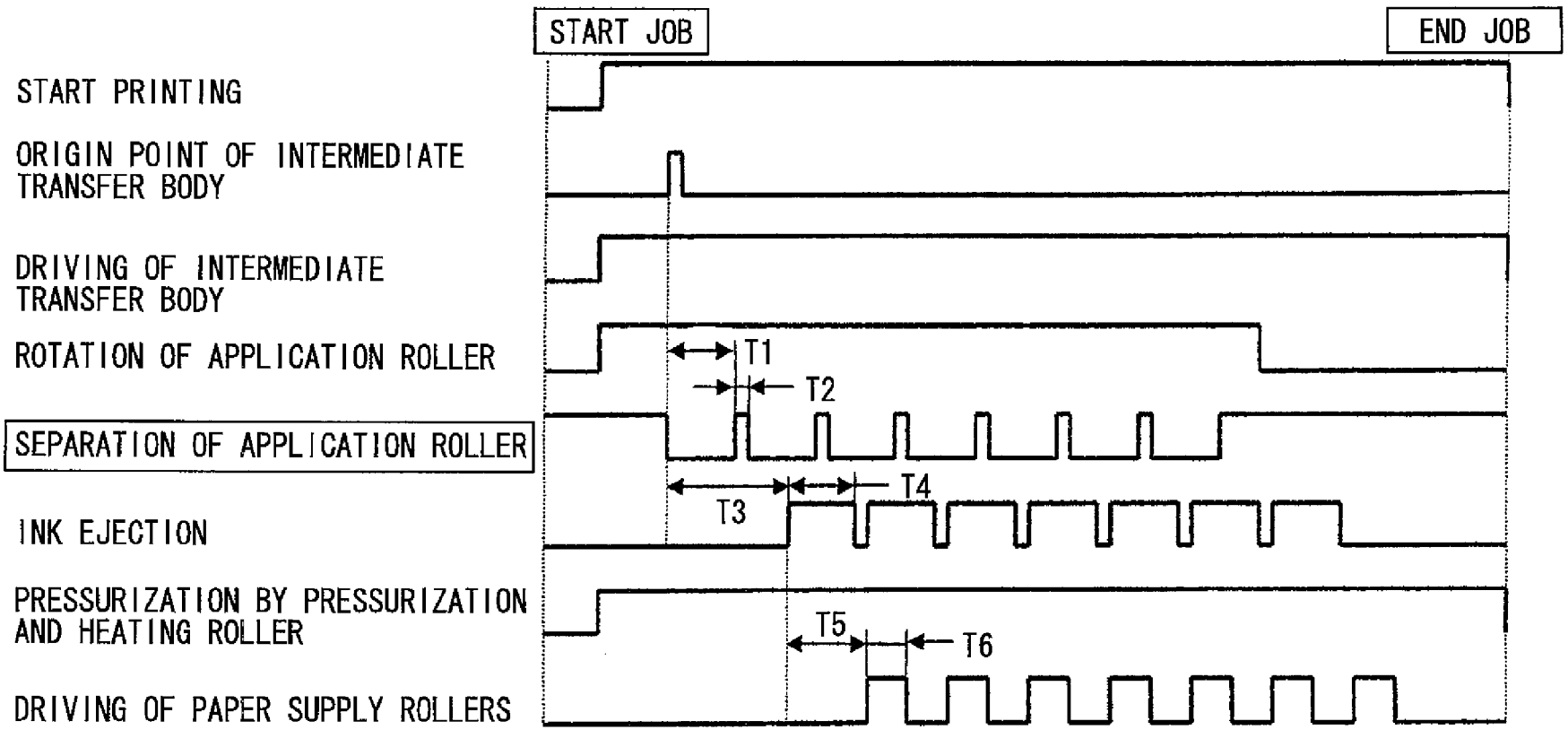
FIG. 12 is a timing chart of each of the units of the inkjet recording apparatus.

The reference symbols in FIG. 12 are as indicated below.

T1: Conveyance time of intermediate transfer body 12 corresponding to length Lm of recording medium 34.

T2: Conveyance time of intermediate transfer body 12 corresponding to spacing Ls between sheets of recording media 34.

T3: Conveyance time of intermediate transfer body 12 corresponding to the distance from the application roller 42 to the position of the ejection tip of the ink ejection unit 16.

T4: Conveyance time of the intermediate transfer body corresponding to the length of the recorded image.

T5: Conveyance time of intermediate transfer body 12 corresponding to the distance from the position of the ejection tip of the ink ejection unit 16 to the transfer roller position.

T6: Conveyance time of intermediate transfer body 12 corresponding to the paper supply length from the paper supply unit 32 to the transfer roller position.

The operational sequence shown in FIG. 12 is as indicated below, and here an example of printing seven sheets of recording media in a continuous fashion is described.

Step 1

The operating conditions are set and the printing by the inkjet recording apparatus 10 is started.

Step 2

Conveyance of intermediate transfer body 12, rotation of the application roller 42 of the treatment liquid application unit 14, and pressurization of the pressurization and heating roller 36, are started. The elevator movement apparatus 46 of the treatment liquid application unit 14 controls the cam mechanism, and the application roller 42 is maintained in a state where it is separated from the intermediate transfer body 12. Accordingly, the application of the treatment liquid L is not yet carried out.

Step 3

The origin point of the intermediate transfer body 12 is determined and when the origin point of the intermediate transfer body 12 has reached the position of the application roller 42, the elevator movement apparatus 46 releases the separation of the application roller 42 and starts application of treatment liquid L to the intermediate transfer body 12. Thereupon, when the treatment liquid L has been applied in accordance with a length of the intermediate transfer body 12 which corresponds to the length of the recording medium 34, the elevator movement apparatus 46 controls the cam mechanism so that the application roller 42 is separated from the intermediate transfer body 12 in accordance with a length of the intermediate transfer body 12 corresponding to the spacing Ls between the recording media 34. Thereafter, the elevator movement apparatus 46 repeats the application in accordance with the length of the intermediate transfer body corresponding to the length of the recording medium 34, and the halting of application in accordance with the length of the intermediate transfer body corresponding to the spacing between recording media 34, for a number of times corresponding to the number of sheets of recording medium 34 (7 sheets).

Step 4

When the front tip of the image region in the intermediate transfer body 12 reaches the position of the ejection tip of the ink ejection unit 16, ejection of ink is started. The inks of respective colors are ejected through a length corresponding to the image length, thereby forming an ink image.

Step 5

In synchronism with the front tip of the image region of the intermediate transfer body 12 reaching the transfer position of the pressurization and heating roller 36, the paper supply rollers 32A and 32B of the paper supply unit 32 are driven, and recording media 34 are is supplied to the transfer unit 18.

Step 6

The ink image is transferred to the recording media 34 in the transfer unit 18 and a corresponding number of sheets are output.

Step 7

When the transfer on the number of sheets has ended and the recording media 34 have exited from the pressurization and heating roller 36, then the job ends and the respective units are successively halted and returned to their initial states.

Figure 13B:
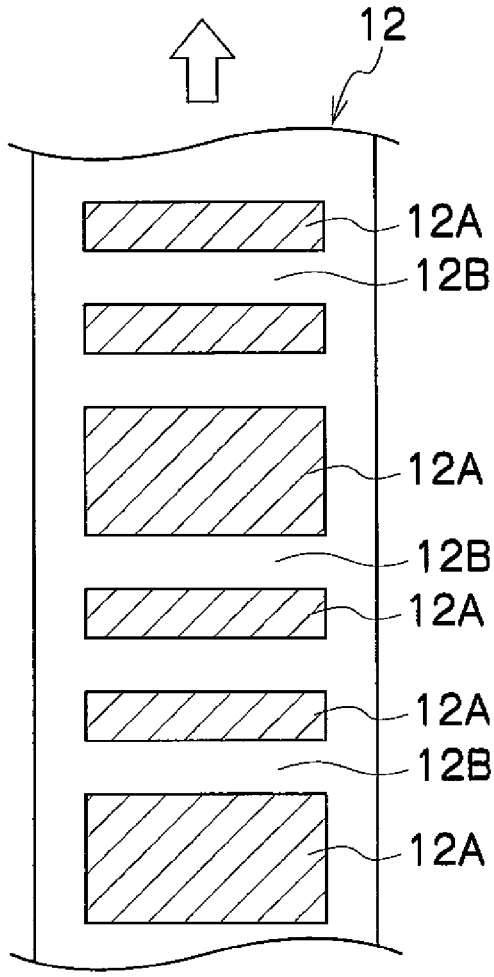

The examples of intermittent application described above relate to a case where a treatment liquid L is not applied between sheets of recording media, as in FIG. 13A. However, as shown in FIG. 13B, if a treatment liquid L is applied intermittently to the intermediate transfer body 12 in accordance with printing regions and non-printing regions which are formed on the recording medium 34, then it is necessary to input, to the CPU, the positional relationships between the printing regions and the non-printing regions of the recording medium 34 and the image regions 12A and the non-image regions 12B of the intermediate transfer body 12, in the transfer unit 18. Furthermore, in the case of FIG. 13B, desirably, application rollers 42 of different lengths can be prepared, and these rollers can be exchanged in accordance with the width of the image regions 12A.

The following beneficial effects can be obtained by the inkjet recording method and apparatus according to embodiments of the present invention which are described above.

(1) By applying the treatment liquid L to the intermediate transfer body 12 with an application apparatus 44 which comprises an application roller 42, it is possible to apply the treatment liquid L to the intermediate transfer body 12 in a film of uniform thickness, and therefore the speed of the image forming device is raised, uniformity is promoted, and stable print output of high quality can be achieved.

(2) By intermittently separating the application roller 42 and the intermediate transfer body 12, it is possible to halt the application of treatment liquid to the non-image regions 12B, and soiling of the pressurization and heating roller 36 and printing through to the rear surface of the recording medium 34 can be prevented.

(3) By eliminating the treatment liquid remaining on the intermediate transfer body 12, it is possible to improve the maintenance characteristics of the whole apparatus, while reducing the load involved in the cleaning step.

(4) By eliminating unnecessary application of treatment liquid, it is possible to reduce the amount of treatment liquid used, as well as lowering the running costs.

The embodiments described above are in relation to examples of an inkjet recording method based on a two-liquid transfer system in which the supporting body is an intermediate transfer body 12. However, the present invention can also be applied to an inkjet recording method which uses a recording medium 34 as the supporting body and forms an ink image by depositing treatment liquid and ink directly onto the recording medium 34, without passing via an intermediate transfer body 12.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An intermittent application method of intermittently applying an application liquid to a continuously conveyed band-shaped or cut-sheet-shaped supporting body, the intermittent application method comprising the step of causing a lower surface of the supporting body, and a circumferential surface of an application cylinder which takes up the application liquid from an application liquid reservoir by rotation, to make contact with each other and separate from each other in a relative manner by means of a cam mechanism in such a manner that an application section where the application liquid is applied, and a non-application section where the application liquid is not applied, are formed on the lower surface of the supporting body.

2. The intermittent application method as defined in claim 1, wherein the application cylinder is rotated at same speed of rotation during separation of the supporting body and the application cylinder as speed of rotation of the application cylinder during contact between the supporting body and the application cylinder.

3. The intermittent application method as defined in claim 1, wherein the cam mechanism causes the application cylinder to make contact with and separate from the supporting body.

4. The intermittent application method as defined in claim 1, wherein the cam mechanism causes the supporting body to make contact with and separate from the application cylinder.

5. An inkjet recording method comprising a treatment liquid application step of previously applying a treatment liquid to aggregate an ink to a continuously conveyed band-shaped or cut-sheet-shaped supporting body, before ejecting the ink onto the supporting body, wherein, in the treatment liquid application step, a lower surface of the supporting body, and a circumferential surface of an application cylinder which takes up the treatment liquid from a treatment liquid reservoir by rotation are caused to come into contact with each other and separate from each other in a relative manner by means of a cam mechanism, in such a manner that the treatment liquid is applied intermittently only onto an image region on a lower surface of the supporting body where an ink image is to be formed and the treatment liquid is not applied onto a non-image region on the lower surface of the supporting body where an ink image is not to be formed.

6. The inkjet recording method as defined in claim 5, wherein the supporting body is an intermediate transfer body on which the ink reacts with the treatment liquid to form the ink image and which transfers the image onto a recording medium.

7. The inkjet recording method as defined in claim 5, wherein the supporting body is a recording medium on which the ink reacts with the treatment liquid to form the ink image.

8. An intermittent application apparatus which intermittently applies an application liquid to a continuously conveyed band-shaped or cut-sheet-shaped supporting body, the intermittent application apparatus comprising:

an application head having an application cylinder which takes up the application liquid from an application liquid reservoir and applies the application liquid to the supporting body by rotation; and an elevator movement apparatus having a cam mechanism which raises and lowers the application head or the supporting body to cause the supporting body and a circumferential surface of the application cylinder to make contact with each other and separate from each other in a relative manner in such a manner that the application liquid is intermittently applied to the supporting body.

9. The intermittent application apparatus as defined in claim 8, wherein the application cylinder is rotated at same speed of rotation during separation of the supporting body and the application cylinder as speed of rotation of the application cylinder during contact between the supporting body and the application cylinder.

10. The intermittent application apparatus as defined in claim 8, wherein the cam mechanism includes:

a circular disk-shaped cam member which is driven to rotate and has at least one cam groove formed in a circumferential surface of the circular disk-shaped cam member; and a cam follower which is disposed in contact with the circular disk-shaped cam member so that the earn follower can be driven and rotated by the circular disk-shaped cam member, and which is raised and lowered instantaneously by dropping into the at least one cam groove and exiting from the at least one cam groove while the circular disk-shaped cam member is driven to rotate, wherein the application head is raised and lowered in conjunction with raising and lowering movement of the cam follower; and a contact position of the cam follower with respect to the circular disk-shaped cam member when the circular disk-shaped cam member starts rotation is a position on the circumferential surface of the circular disk-shaped earn member which is furthest from the at least one cam groove.

11. The intermittent application apparatus as denied in claim 8, wherein the cam mechanism includes:

a circular disk-shaped cam member which is driven to rotate and has at least one cam projection formed in a circumferential surface of the circular disk-shaped cam member; and a cam follower which is disposed in contact with the circular disk-shaped cam member so that the cam follower can be driven and rotated by the circular disk-shaped cam member, and which is raised and lowered instantaneously by being caused to project out by the at least one cam projection and exiting from the at least one cam projection while the circular disk-shaped cam member is driven to rotate, wherein the supporting body is raised or lowered in conjunction with raising and lowering movement of the cam follower; and a contact position of the cam follower with respect to the circular disk-shaped cam member when the circular disk-shaped cam member starts rotation is a position on the circumferential surface of the circular disk-shaped cam member which is furthest from the at least one cam projection.

12. The intermittent application apparatus as defined in claim 8, wherein the elevator movement apparatus includes a guide mechanism which guides an operation of causing the supporting body and the circumferential surface of the application cylinder to come into contact with each other and to separate from each other in a relative manner by the cam mechanism.

13. An inkjet recording apparatus comprising a treatment liquid application unit which previously applies a treatment liquid to aggregate an ink to a continuously conveyed band-shaped or cut-sheet-shaped supporting body, before ejecting the ink onto the supporting body, wherein the treatment liquid application unit includes:

an application apparatus having an application cylinder which takes up the treatment liquid from a treatment liquid reservoir and applies the treatment liquid to the supporting body by rotation; and an elevator movement apparatus having a cam mechanism which raises and lowers the application apparatus or the supporting body to cause the supporting body and a circumferential surface of the application cylinder to make contact with each other and separate from each other in a relative manner in such a manner that the treatment liquid is intermittently applied to the supporting body.

* * * * *